US007328544B2

(12) United States Patent
Yokota et al.

(10) Patent No.: US 7,328,544 B2
(45) Date of Patent: Feb. 12, 2008

(54) BAG-MANUFACTURING AND PACKAGING SYSTEM

(75) Inventors: Yuji Yokota, Ritto (JP); Seisaku Iwasa, Moriyama (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 10/562,398

(22) PCT Filed: Jun. 2, 2005

(86) PCT No.: PCT/JP2005/010125

§ 371 (c)(1),
(2), (4) Date: Dec. 27, 2005

(87) PCT Pub. No.: WO2006/003769

PCT Pub. Date: Jan. 12, 2006

(65) Prior Publication Data

US 2006/0156691 A1 Jul. 20, 2006

(30) Foreign Application Priority Data

| | | |
|---|---|---|
| Jul. 5, 2004 | (JP) | 2004-198326 |
| Oct. 22, 2004 | (JP) | 2004-308190 |
| Apr. 18, 2005 | (JP) | 2005-119861 |

(51) Int. Cl.
*B65B 61/00* (2006.01)
*B65B 43/26* (2006.01)

(52) U.S. Cl. ..... 53/167; 53/570

(58) Field of Classification Search ..... 53/167, 53/52, 570, 571, 572, 389.1–2, 389.5, 389.2, 53/389.4–5, 384.1, 385.1, 386.1; 493/196, 493/201, 480
See application file for complete search history.

(56) References Cited

U.S. PATENT DOCUMENTS

| | | | |
|---|---|---|---|
| 4,514,959 A | 5/1985 | Shroyer | |
| 2002/0014055 A1 | 2/2002 | Iwasa et al. | |

FOREIGN PATENT DOCUMENTS

| | | | | |
|---|---|---|---|---|
| JP | 4-68801 U | | 6/1992 | |
| JP | 5-34107 U | * | 5/1993 | ..... 493/3 |
| JP | 11-011441 A | | 1/1999 | |
| JP | 2002-037206 A | | 2/2002 | |

* cited by examiner

*Primary Examiner*—Rinaldi I. Rada
*Assistant Examiner*—John Paradiso
(74) *Attorney, Agent, or Firm*—Global IP Counselors, LLP

(57) ABSTRACT

In order to provide a bag-manufacturing and packaging system that can smoothly convey a bag in a conveyance section disposed downstream of the bag-manufacturing and packaging machine, the bag-manufacturing and packaging system of the present invention includes a rotating brush mechanism disposed between a transverse sealing mechanism and a chute conveyor. The rotating brush mechanism sandwiches, between two rotating brushes, a bag dropped from the transverse sealing mechanism, and conveys the bag to the chute conveyor even when the bag is dropped at a position other than the predetermined discharge position.

27 Claims, 27 Drawing Sheets

(a)

(b)

(a)

(b)

BAG-MANUFACTURING AND PACKAGING SYSTEM

TECHNICAL FIELD

The present invention relates to a bag-manufacturing and packaging system provided with a vertical bag-manufacturing and packaging machine that makes a bag by sealing a tubular continuous packaging material filled with items to be packaged, and which cuts and discharges the bag.

BACKGROUND ART

There exists a bag-manufacturing and packaging machine as a vertical bag-manufacturing and packaging system that fills the inside of a bag with items to be packaged, such as snack candy, while manufacturing the bag.

For example, a bag-manufacturing and packaging machine called a vertical pillow packaging machine forms a packaging material that is a sheet-like film into a tubular shape with a former and a tube, and thermally seals (thermally weld) together the overlapping longitudinal edges of the tubular packaging material with a longitudinal sealing mechanism to form a tubular packaging material. Then, the inside of the tubular packaging material that eventually becomes the bag is filled from a tube with items to be packaged. The tubular packaging material is thermally sealed with sealing jaws of a transverse sealing mechanism that is below the tube, at a portion that extends over the upper end portion of the bag and the lower end portion of the subsequent bag. Then, the middle of the thermally sealed portion (transverse seal portion) is cut with a cutter.

Then, the cut bag is received by a chute conveyer disposed directly below the transverse sealing mechanism and conveyed to a post-processing device such as a seal checker disposed downstream.

[Patent Document 1]

Japanese Patent Application Publication No. 2002-037206 (published on Feb. 6, 2002)

DISCLOSURE OF THE INVENTION

Problem that the Invention is to Solve

However, the above conventional vertical pillow packaging machine has the following problems.

Namely, although the bags sealed by the transverse sealing mechanism are individually cut by the cutter, sometimes the cut bags cling to one of the pair of sealing jaws included in the transverse sealing mechanism. In this case, there is a possibility that a bag that should be dropped to the conveyance unit immediately after being cut moves together with the sealing jaw, and that the discharge position varies. In a configuration in which the sealing jaws seal the bags and move in the conveyance direction of the chute conveyer, the position at which a bag clinging to the sealing jaws is dropped to the chute conveyor becomes displaced in the conveyance direction, and the interval (pitch) of the bag on the chute conveyor cannot be maintained at a constant. Particularly when the speed at which the vertical bag-manufacturing and packaging machine runs is increased, such pitch displacement of the bag becomes pronounced. As a result, problems arise, such as bags accumulating in a post-processing device, and bags that cannot be completely post-processed in a post-processing device.

It is an object of the present invention to provide a bag-manufacturing and packaging system that can smoothly convey bags in a conveyance unit disposed downstream of a bag-manufacturing and packaging machine.

Means for Solving the Problem

The bag-manufacturing and packaging system pertaining to a first invention comprises a vertical bag-manufacturing and packaging machine, a conveyance unit, and a drop orientation control unit. The vertical bag-manufacturing and packaging machine manufactures a bag by sealing a tubular continuous packaging material filled with items to be packaged, and cuts and discharges the bag. The conveyance unit receives the bag discharged from the vertical bag-manufacturing and packaging machine and conveys the bag downstream. The drop orientation control unit is disposed between the vertical bag-manufacturing and packaging machine and the conveyance unit and feeds the bag discharged from the vertical bag-manufacturing and packaging machine to a predetermined position on the conveyance unit while maintaining the drop orientation of the bag.

Here, the bag-manufacturing and packaging system includes the drop orientation control unit that is disposed between the vertical bag-manufacturing and packaging machine and the conveyance unit that conveys the bag downstream at which a post-processing device is disposed, and feeds the bag discharged from the vertical bag-manufacturing and packaging machine in a hanging state to a predetermined position on the conveyance unit while maintaining the drop orientation of the bag. Here, the drop orientation control unit is a mechanism that feeds, at a predetermined orientation, the bag manufactured in the vertical bag-manufacturing and packaging machine to the conveyance unit. For instance, a pair of rotors, a combination of a rotor and a chute, and a combination of a rotor and a conveyance belt are conceivable.

Thus, the drop orientation of each bag can be prevented from changing and the landing point in the conveyance unit can be prevented from being displaced, so that the landing point in the conveyance unit can be stabilized. As a result, the bag-manufacturing and packaging system that can stably convey the bag manufactured in the vertical bag-manufacturing and packaging machine can be obtained.

The bag-manufacturing and packaging system pertaining to a second invention is the bag-manufacturing and packaging system pertaining to the first invention, wherein the drop orientation control unit includes a rotor that feeds the bag discharged from the vertical bag-manufacturing and packaging machine to the predetermined position on the conveyance unit.

Here, the bag-manufacturing and packaging system includes the rotor that is disposed between the vertical bag-manufacturing and packaging machine and the conveyance unit that conveys the bag downstream at which a post-processing device is disposed. The rotor feeds the bag discharged from the vertical bag-manufacturing and packaging machine in a hanging state to a predetermined position on the conveyance unit.

Thus, even if the discharge position of the bag discharged from the vertical bag-manufacturing and packaging machine is displaced, the bag can be fed from the rotor to the conveyance unit after the bag has been guided to the rotor. For this reason, the interval (pitch) of the bag conveyed in the conveyance unit can be prevented from being displaced. Also, because the bag is fed by the rotor to the conveyance unit, the bag, which is conveyed in a substantially vertical direction and tends to have a swelled bottom due to items to be packaged settling at the bottom, can be evened out and conveyed to the conveyance unit. As a result, the phenomenon in which the bottom-swollen bag rotates during conveyance in the conveyance unit can be prevented, and the bag-manufacturing and packaging system that can stably convey the bag manufactured in the vertical bag-manufacturing and packaging machine can be obtained. Moreover, because the bag discharged from the vertical bag-manufacturing and packaging machine is conveyed toward the conveyance unit while being wrapped by the rotor, the bag can be cut from the vertical bag-manufacturing and packaging machine.

The bag-manufacturing and packaging system pertaining to a third invention is the bag-manufacturing and packaging system pertaining to the first invention, wherein the drop orientation control unit includes a pair of rotors that sandwich the bag discharged from the vertical bag-manufacturing and packaging machine and feed the bag to the predetermined position on the conveyance unit.

Here, the bag-manufacturing and packaging system includes the pair of rotors that are disposed between the vertical bag-manufacturing and packaging machine and the conveyance unit that conveys the bag downstream at which a post-processing device is disposed, sandwich the bag discharged from the vertical bag-manufacturing and packaging machine in a hanging state, and convey the bag to a predetermined position on the conveyance unit. Thus, even if the discharge position of the bag discharged from the vertical bag-manufacturing and packaging machine is displaced, the bag can be fed from between the pair of rotors to the conveyance unit after the bag has been guided to between the pair of rotors. For this reason, the interval (pitch) of the bag conveyed in the conveyance unit can be prevented from being displaced. Also, because the bag is sandwiched between and fed by the pair of rotors to the conveyance unit, the bag, which is conveyed in a substantially vertical direction and tends to have a swelled bottom due to items to be packaged settling at the bottom, can be evened out and conveyed to the conveyance unit. As a result, the phenomenon in which the bottom-swollen bag rotates during conveyance in the conveyance unit can be prevented, and the bag-manufacturing and packaging system that can stably convey the bag manufactured in the vertical bag-manufacturing and packaging machine can be obtained. Moreover, because the bag discharged from the vertical bag-manufacturing and packaging machine is sandwiched between and conveyed by the pair of rotors to the conveyance unit, the bag can be cut from the vertical bag-manufacturing and packaging machine.

The bag-manufacturing and packaging system pertaining to a fourth invention is the bag-manufacturing and packaging system of the third invention, wherein the pair of rotors have elasticity in a radial direction around their rotational axes.

Here, the pair of rotors are elastic in a radial direction around their rotational axes, such as brushes or sponges.

Thus, the bag discharged from the vertical bag-manufacturing and packaging machine is sandwiched between and conveyed by the rotors, whereby appropriate pressure can be applied from both sides of the bag and bias of the items to be packaged can be evened out. As a result, the bag can be fed to the conveyance unit while maintaining the interval of the bag at a constant and without damaging the items to be packaged in the bag.

Also, because the rotors are elastic, there is also the advantage that it becomes unnecessary to strictly set the interval between the rotors each time the size of the bag changes.

The bag-manufacturing and packaging system pertaining to a fifth invention is the bag-manufacturing and packaging system of the third or fourth invention, wherein the interval between the pair of rotors is adjustable.

Here, the interval between the pair of rotors that sandwich and convey the bag can be adjusted.

For this reason, the interval between the rotors can be adjusted in accordance with the size of the bag manufactured in the vertical bag-manufacturing and packaging machine, and the bag can be sandwiched with appropriate pressure.

The bag-manufacturing and packaging system pertaining to a sixth invention is the bag-manufacturing and packaging system of any one of the third to fifth inventions, wherein the pair of rotors are independently driven.

Here, because the pair of rotors are separately driven, a difference can be given to the rotational speeds of the rotors.

Thus, bias of the items to be packaged in the bag sandwiched between the rotors can be more easily evened out. Also, by giving a difference to the rotational speeds of the rotors, the bag can be discharged in a state where the orientation of the bag fed to the conveyance unit is slanted at a desired orientation. Thus, the bag can be more stably conveyed by slanting and discharging the bag in accordance with the angle of the conveyance surface of the conveyance unit.

The bag-manufacturing and packaging system pertaining to a seventh invention is the bag-manufacturing and packaging system of any one of the third to sixth inventions, further comprising a rotation control unit that controls the rotational speed of the pair of rotors.

Here, the rotational speed of the rotors is controlled by the rotation control unit.

Thus, the rotational speed of the rotors can be controlled to be an appropriate rotational speed in accordance with the abilities of the bag-manufacturing and packaging machine and the conveyance unit and the type of items to be packaged.

The bag-manufacturing and packaging system pertaining to an eighth invention is the bag-manufacturing and packaging system of any one of the third to seventh inventions, wherein the pair of rotors are disposed such that the rotational axes of the rotors are horizontal.

Here, the pair of rotors are disposed such that the rotational axes of the rotors are horizontal.

Thus, the bag discharged from the vertical bag-manufacturing and packaging machine can be discharged directly downward, and a bag where the bias of the items to be packaged has been evened out can be directly dropped to the conveyance unit.

The bag-manufacturing and packaging unit pertaining to a ninth invention is the bag-manufacturing and packaging system of any one of the third to eighth inventions, wherein the pair of rotors are disposed such that the rotational axes of the rotors are slanted from a horizontal direction.

Here, the pair of rotors are disposed such that the rotational axes of the rotors are slanted from a horizontal direction.

Thus, the bag discharged from the vertical bag-manufacturing and packaging machine can be discharged in a slanted direction, and the bag can be slantedly discharged in correspondence to the inclination of the conveyance unit.

The bag-manufacturing and packaging system pertaining to a tenth invention is the bag-manufacturing and packaging system of any one of the third to ninth inventions, wherein the vertical bag-manufacturing and packaging machine includes a longitudinal sealing mechanism that seals the packaging material along a conveyance direction when forming the sheet-like packaging material into a tubular form and a transverse sealing mechanism that seals the tubular packaging material in a direction perpendicular to the conveyance direction of the packaging material. Also, the pair of rotors are disposed at a position that is directly below a discharge position of the bag in the transverse sealing mechanism and lower by about the conveyance direction length of one bag.

Here, the rotors are disposed directly below the transverse sealing mechanism of the vertical bag-manufacturing and packaging machine.

Thus, after being transversely sealed in the transverse sealing mechanism, the bags individually cut and discharged can be smoothly delivered to the conveyance unit through the rotors.

The bag-manufacturing and packaging system pertaining to an eleventh invention is the bag-manufacturing and packaging system of the tenth invention, wherein the transverse sealing mechanism includes a pair of rotary-type sealing jaws.

Here, the transverse sealing mechanism includes a pair of rotary-type sealing jaws.

Thus, even if the seal portion of the bag clings to one of the sealing jaws that moves away after the seal portion is sealed between the two sealing jaws and the discharge position is displaced from the ordinary position due to the movement of the sealing jaws, the bag can be guided between the pair of rotors and conveyed from there to the conveyance unit. Thus, disturbances in the pitch of the bag in the conveyance unit can be avoided.

The bag-manufacturing and packaging system pertaining to a twelfth invention is the bag-manufacturing and packaging system of any one of the third to eleventh inventions, wherein the conveyance unit is disposed at a position that is directly below the pair of rotors and lower by about the conveyance direction length of one bag.

Here, because the conveyance unit is disposed below the pair of rotors by about the length of one bag, the bag can be smoothly conveyed downstream without imparting shock to the bag that is dropped from between the pair of rotors.

The bag-manufacturing and packaging system pertaining to a thirteenth invention is the bag-manufacturing and packaging system of any one of third to twelfth inventions, wherein the pair of rotors are disposed at an intermediate position joining the discharge position of the bag in the vertical bag-manufacturing and packaging machine and a drop point of the bag in the conveyance unit.

Here, the pair of rotors are disposed at an intermediate position between the discharge position of the bag in the vertical bag-manufacturing and packaging machine and a drop point of the bag in the conveyance unit.

Thus, the bag can be smoothly received from the bag-manufacturing and packaging machine and smoothly delivered to the conveyance unit.

The bag-manufacturing and packaging system pertaining to a fourteenth invention is the bag-manufacturing and packaging system of any one of the third to thirteenth inventions, wherein the conveyance unit comprises a belt conveyor that is pivotable using one end of the belt conveyor in the conveyance direction as the pivot center.

Here, the conveyance unit pivots around one end in the conveyance direction.

Thus, the height position with respect to the vertical bag-manufacturing and packaging machine and the angle of the conveyance surface can be adjusted. Thus, the height position and the angle of the conveyance surface can be adjusted to an appropriate height position and conveyance surface angle in accordance with the size of the bag, and conveyance of the bag can be smoothly conducted.

The bag-manufacturing and packaging system pertaining to a fifteenth invention is the bag-manufacturing and packaging system of any one of the third to fourteenth inventions, further comprising a rotor interval adjustment unit that adjusts the interval between the pair of rotors, and an interval control unit that automatically controls the adjustment of the interval between the pair of rotors by the rotor interval adjustment unit.

For example, in a case where a problem such as misweighing occurs and a long bag or a bag that is significantly lighter than the standard weight is manufactured in the vertical bag-manufacturing and packaging machine, or in a case where the bag-manufacturing and packaging machine continues running even when a post-processing device such as a seal checker has stopped, the interval control unit can control the rotor interval adjustment unit to increase the interval between the pair of rotors. Here, there is a possibility that it is unable to smoothly convey a long bag or a bag that is abnormally light in the conveyance unit such as a belt conveyor. Thus, in the bag-manufacturing and packaging system of the present invention, even if such an abnormal bag is conveyed from the bag-manufacturing and packaging machine, the interval between the rotors can be maximized to prevent a long bag from getting caught in the conveyance unit and prevent abnormalities such as a stall in the conveyance.

The bag-manufacturing and packaging system pertaining to a sixteenth invention is the bag-manufacturing and packaging system pertaining to the fifteenth invention, wherein the interval control unit controls the rotor interval adjustment unit in accordance with the size of the bag to be manufactured in the vertical bag-manufacturing and packaging machine.

Here, the interval control unit controls the rotor interval adjustment unit in accordance with the size of the bag to be manufactured in the vertical bag-manufacturing and packaging machine.

Thus, even when the size of the bag to be manufactured is changed, or when a bag of an abnormal size such as a long bag has been manufactured when an abnormality in the measurement occurs, the interval control unit can control the rotor interval adjustment unit to adjust the interval between the pair of rotors in accordance with the size and length of the bag.

The bag-manufacturing and packaging system pertaining to a seventeenth invention is the bag-manufacturing and packaging system of any one of the third to sixteenth inventions, further comprising a positioning member that determines the relative position of the pair of rotors with respect to the vertical bag-manufacturing and packaging machine.

Here, the positioning member is used to precisely align the delivery position of the bag discharged from the bag-manufacturing and packaging machine with the reception position of the bag in the pair of rotors.

Thus, the delivery of the bag to the pair of rotors from the bag-manufacturing and packaging machine can be smoothly conducted, and misconveyance of the bag resulting from an imprecise disposition can be avoided.

The bag-manufacturing and packaging system pertaining to an eighteenth invention is the bag-manufacturing and packaging system of any one of the second to seventeenth inventions, wherein the surface of the rotor is formed by an elastic member.

Here, the surface of the rotor is formed by a member having a certain elasticity, such as a brush, a sponge, rubber, or a belt.

Thus, the bag can be conveyed to the predetermined position on the conveyance unit without damaging the bag received from the bag-manufacturing and packaging machine. Also, the landing point on the conveyance unit can be stabilized because it becomes difficult for the discharged bag to be displaced in the horizontal direction. Moreover, because the rotor including an elastic body on its surface rotates, the bag can be more reliably cut from the discharge position in the bag-manufacturing and packaging machine.

The bag-manufacturing and packaging system pertaining to a nineteenth invention is the bag-manufacturing and packaging system of any one of the second to eighteenth inventions, wherein the rotor rotates at the same speed as a drop speed of the bag discharged from the vertical bag-manufacturing and packaging machine or at a faster speed than the drop speed.

Here, the rotational speed of the rotor is controlled using as a reference the drop speed of the bag discharged from the bag-manufacturing and packaging machine.

Thus, the bag can be fed to the conveyance unit while the rotor is rotated at a speed equal to or greater than the drop speed of the bag, whereby the bag wrapped by the rotation of the rotor can be more reliably cut from the bag-manufacturing and packaging machine.

The bag-manufacturing and packaging system pertaining to a twentieth invention is the bag-manufacturing and packaging system of any one of the second to nineteenth inventions, further comprising a cantilever support mechanism that cantilever-supports the rotor.

Here, the rotor that feeds the bag discharged from the bag-manufacturing and packaging machine to the predetermined position on the conveyance unit is supported by a cantilever.

Thus, the rotor can be easily removed from the open end side when the type of rotor is to be changed in accordance with the material and size of the bag or when the periphery of the rotor is to be cleaned. For this reason, a work space for doing work relating to the rotor can be secured, and workability, cleanability, and maintainability can be improved.

The bag-manufacturing and packaging system pertaining to a twenty-first invention is the bag-manufacturing and packaging system of any one of the second to twentieth inventions, further comprising a pullout mechanism that pulls out the rotor from between the vertical bag-manufacturing and packaging machine and the conveyance unit.

Here, the bag-manufacturing and packaging system includes a pullout mechanism that pulls out the rotor from the position between the vertical bag-manufacturing and packaging machine and the conveyance unit.

Thus, the rotor can be easily pulled out from the position between the vertical bag-manufacturing and packaging machine and the conveyance unit when the type of rotor is to be changed in accordance with the material and size of the bag or when the periphery of the rotor is to be cleaned. For this reason, a work space for doing work relating to the rotor can be secured, and workability, cleanability, and maintainability can be improved.

The bag-manufacturing and packaging system pertaining to a twenty-second invention is the bag-manufacturing and packaging system of any one of the second to twenty-first inventions, wherein the rotor is formed by a material whose side portions in the rotational axis direction of the rotor are harder than the center portion.

Here, the rotor is formed such that the hardness of the surface of the rotor is different depending on the position in the rotational axis direction of the rotor.

Thus, because it is easy for the center portion of the rotor to become depressed in accordance with the shape of the bag discharged from the bag-manufacturing and packaging machine, the bag can be reliably fed to the predetermined position on the conveyance unit without damaging the bag. The surface of the rotor may be configured by combining types of elastic materials such as brushes, sponges and rubber, or may be configured by using same materials that have different hardnesses.

The bag-manufacturing and packaging system pertaining to a twenty-third invention is the bag-manufacturing and packaging system of any one of the second to twenty-second inventions, wherein the surface of the rotor is covered by a brush that radially spreads around the rotational axis of the rotor, and bristles of the brush are longer at both side portions in the rotational axis direction of the rotor than those at the center portion.

Here, in regard to the length of the bristles of the brush attached to the surface of the rotor, the rotor is formed such that the bristles are longer at both side portions of the rotor in the rotational axis direction than those at the center portion.

Thus, because the center portion of the rotor in the rotational axis direction that contacts the bag is depressed, it becomes easy for the rotor to fit the shape of the bag. For this reason, the bag can be delivered to the predetermined position on the conveyance unit without damaging the bag.

The bag-manufacturing and packaging system pertaining to a twenty-fourth invention is the bag-manufacturing and packaging system of any one of the second to twenty-third inventions, wherein the rotor includes a cooling mechanism for cooling a seal portion of the bag discharged from the vertical bag-manufacturing and packaging machine.

Here, the seal portion of the bag discharged from the bag-manufacturing and packaging machine is cooled in the rotor disposed directly downstream of the bag-manufacturing and packaging machine. Here, an air nozzle that blows air onto the seal portion of the bag, or numerous blowout holes formed in the core of the rotor, is conceivable as the cooling mechanism.

Thus, by forcibly cooling the seal portion of the bag manufactured in the bag-manufacturing and packaging machine, deterioration of the finish of the seal portion at the time the bag has dropped to the predetermined position in the conveyance unit can be prevented. Also, by blowing air (cooling) in a state where the rotor is gripping the bag, change in the orientation of the bag due to the effect of the flow speed can be prevented, and cooling with a large amount of air also becomes possible.

The bag-manufacturing and packaging system pertaining to a twenty-fifth invention is the bag-manufacturing and packaging system of the first invention, wherein the drop orientation control unit includes a rotor and the conveyance unit, which includes a fixed chute including a conveyance surface disposed at a position facing the rotor.

Here, the rotor and a fixed chute included in the conveyance unit can be used as the drop orientation control unit.

Thus, the bag can be fed to the predetermined position on the conveyance unit while the rotor is rotated, the bag is sandwiched between the rotor and the fixed chute of the conveyance unit, and the orientation of the bag is maintained.

The bag-manufacturing and packaging system pertaining to a twenty-sixth invention is the bag-manufacturing and packaging system of the first invention, wherein the drop orientation control unit includes a rotor and the conveyance unit, which includes a belt conveyor including a conveyance surface disposed at a position facing the rotor.

Here, the rotor and a belt conveyor included in the conveyance unit can be used as the drop orientation control unit.

Thus, the bag can be fed to the predetermined position on the conveyance unit while the rotor is rotated, the belt conveyor of the conveyance unit is driven, the bag is sandwiched between the rotor and the belt conveyor of the conveyance unit and the orientation of the bag is maintained.

The bag-manufacturing and packaging system pertaining to a twenty-seventh invention is the bag-manufacturing and packaging system of the first invention, wherein the drop orientation control unit includes a multiple serial rotor including plural rotors.

Here, the drop orientation control unit is configured by plural rotors.

Thus, the bag can be conveyed to the predetermined position in the conveyance unit, while the orientation of the bag is maintained, by the plural rotating rotors.

The multiple serial rotor may be configured by disposing two or more rotor groups of plural rotors. In this case, the bag is sandwiched between and conveyed by the rotor groups, whereby the bag can be conveyed while the orientation of the bag is maintained.

Effects of the Invention

According to the bag-manufacturing and packaging system of the present invention, even when the discharge position of the bag discharged from the vertical bag-manufacturing and packaging machine is somewhat displaced in the conveyance direction of the conveyance unit, the bag can be guided between the pair of rotors and fed to the conveyance unit from between the pair of rotors. Thus, the interval (pitch) of the bags conveyed in the conveyance unit can be prevented from becoming inconsistent.

A perspective view showing the configuration of the bag-manufacturing and packaging machine of the bag-manufacturing and packaging system pertaining to an embodiment of the invention.

FIG. 2

A front view showing the overall configuration of the bag-manufacturing and packaging system.

FIG. 3

Figure 1:
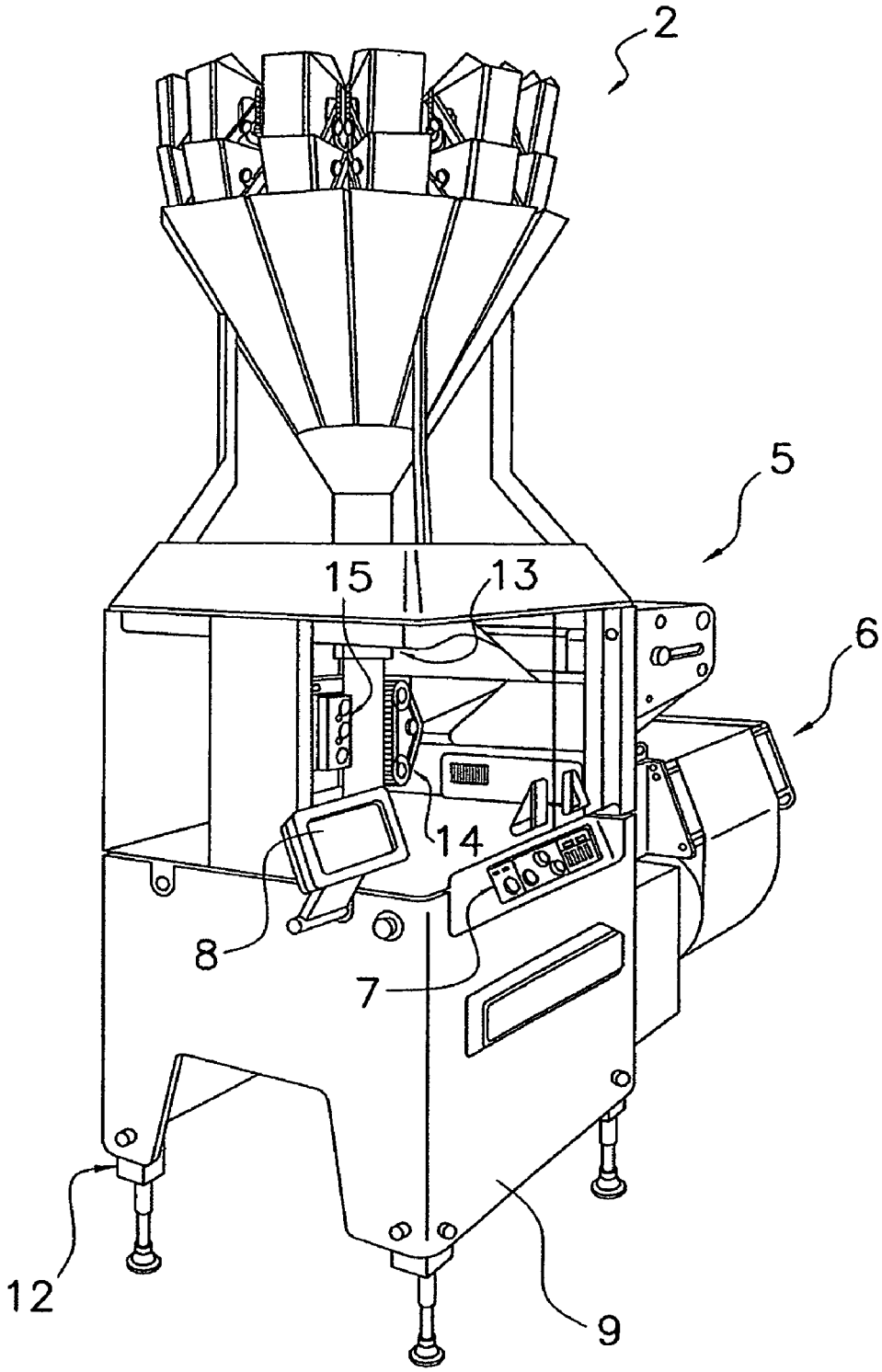
FIG. 1

A front view of a transverse sealing mechanism with which the bag-manufacturing and packaging system of FIG. 1 is provided.

FIG. 4

Figure 3:
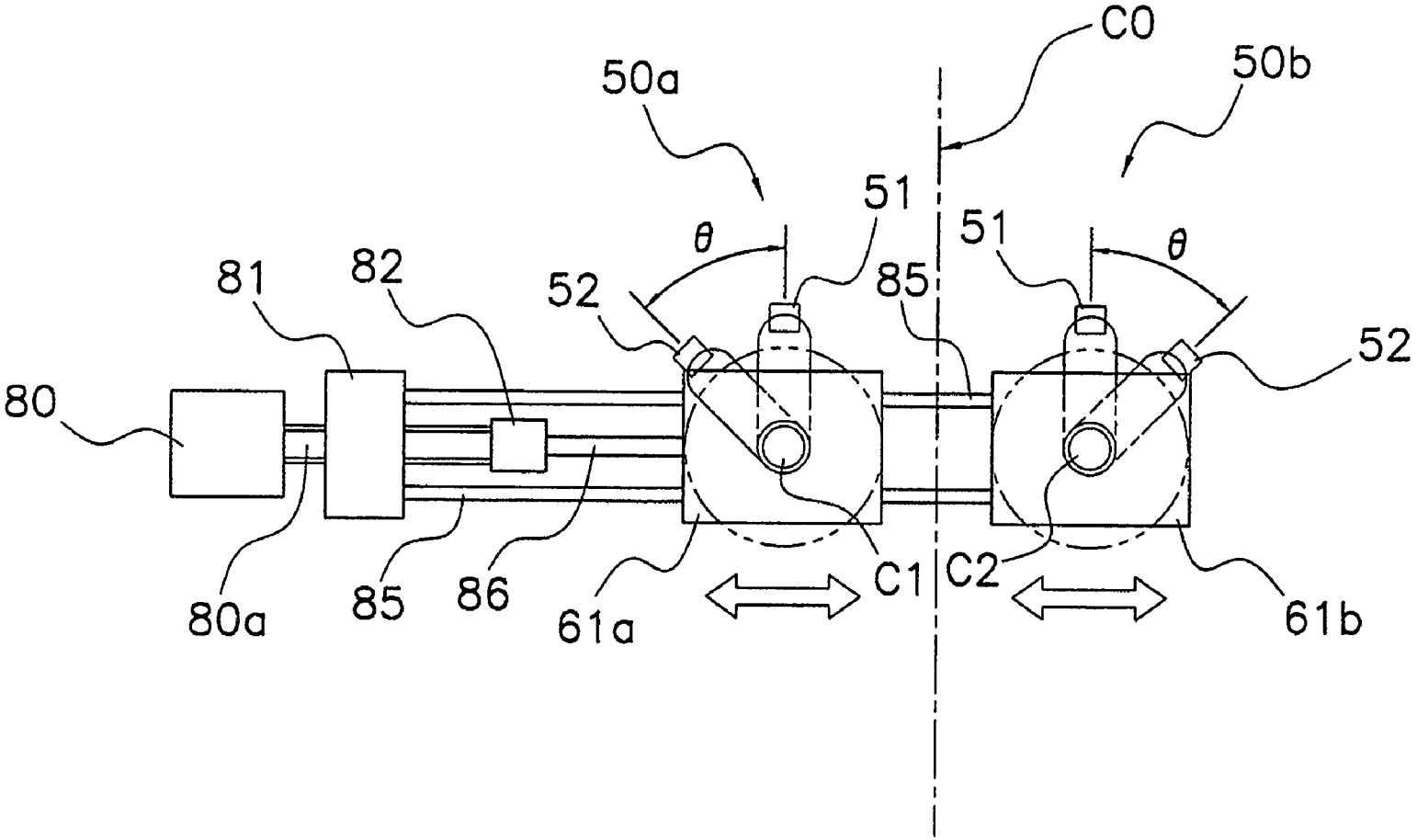

A plan view of the transverse sealing mechanism shown in FIG. 3.

FIG. 5

An external perspective view of a sideways drive mechanism.

FIG. 6

Figure 2:
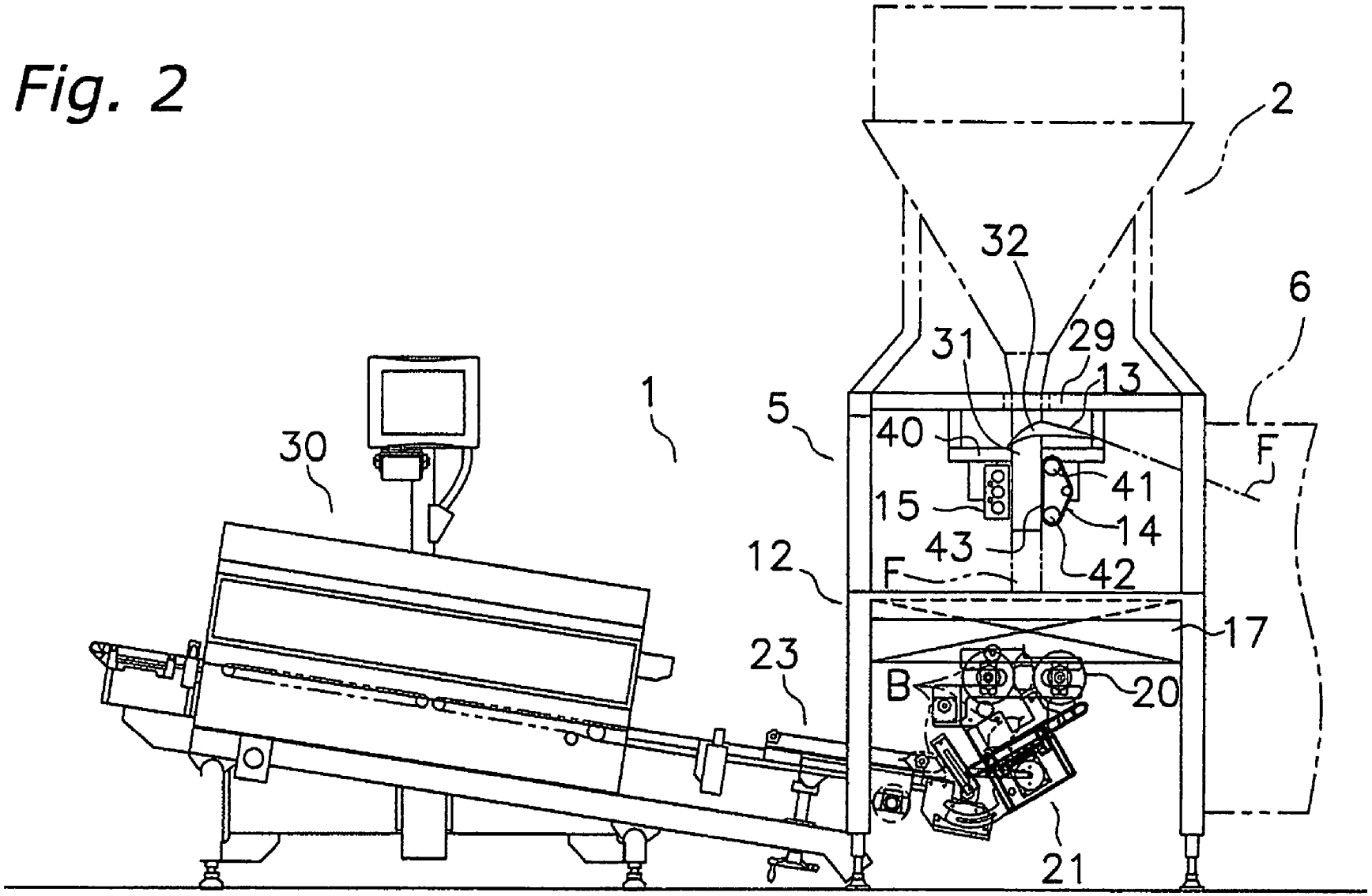

A front view showing the configuration further downstream of the bag-manufacturing and packaging section of the bag-manufacturing and packaging system of FIG. 2.

FIG. 7

A front view showing the positional relationship between the transverse sealing mechanism, a rotating brush mechanism, and a chute conveyer with which the bag-manufacturing and packaging system of FIG. 2 is provided.

FIG. 8

Figure 7:
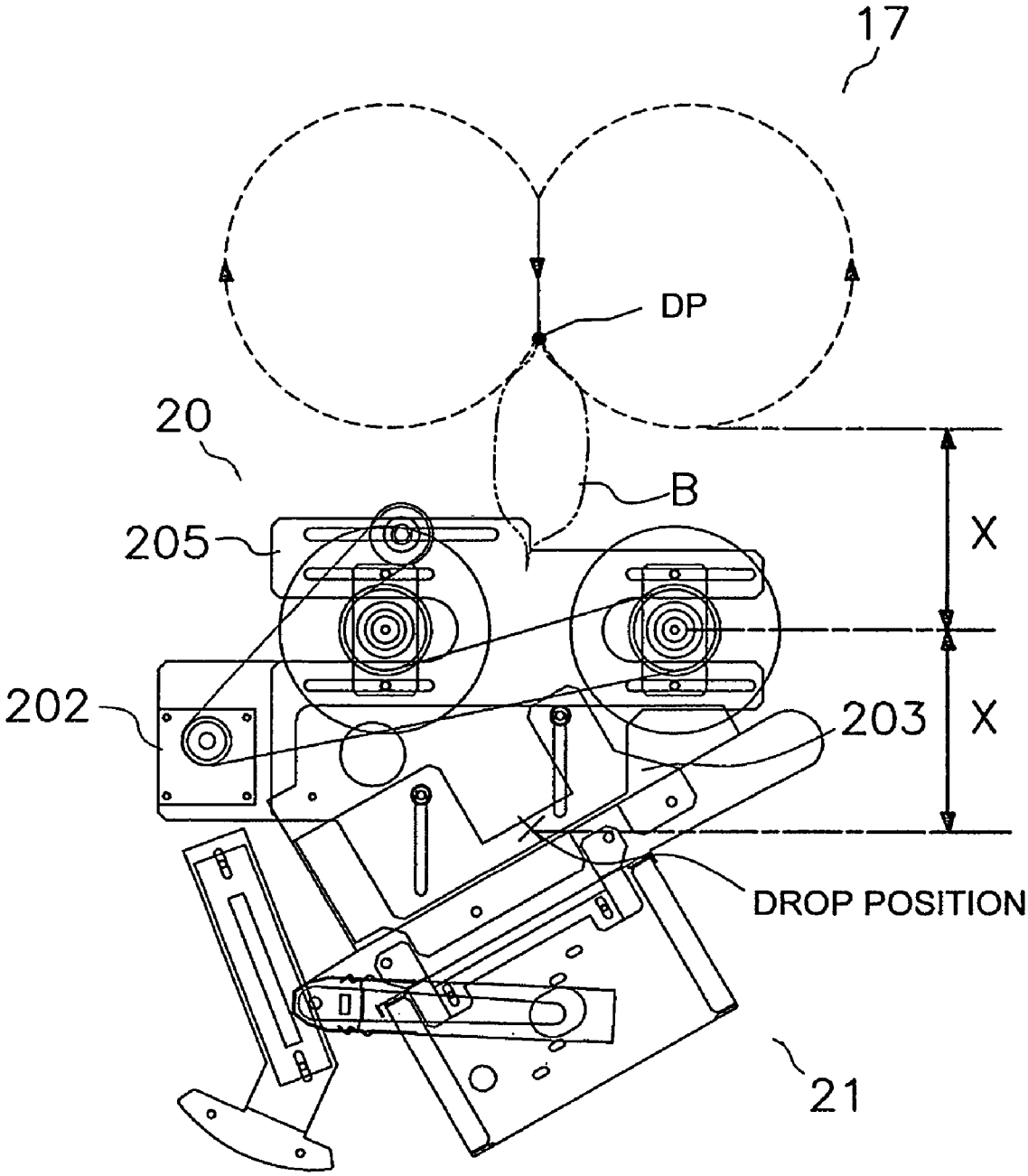

A front view showing the rotating brush mechanism of FIG. 7.

FIG. 9

A plan view showing the rotating brush mechanism of FIG. 7.

FIG. 10

A front view showing the chute conveyor with which the bag-manufacturing and packaging system of FIG. 2 is provided.

FIG. 11

A diagram showing an example where a discharge position in the transverse sealing mechanism is displaced.

FIG. 12

(*a*) is a diagram showing a bag hanging from the transverse sealing mechanism and whose bottom is swollen. (*b*) is a diagram showing a bag passing through the rotating brush mechanism and which has been evened out.

FIG. 13

A front view showing a rotating brush mechanism pertaining to another embodiment of the invention.

FIG. 14

A front view showing a rotating brush mechanism pertaining to yet another embodiment of the invention.

FIG. 15

A front view showing a rotating brush mechanism pertaining to still another embodiment of the invention.

FIG. 16

Figure 15:
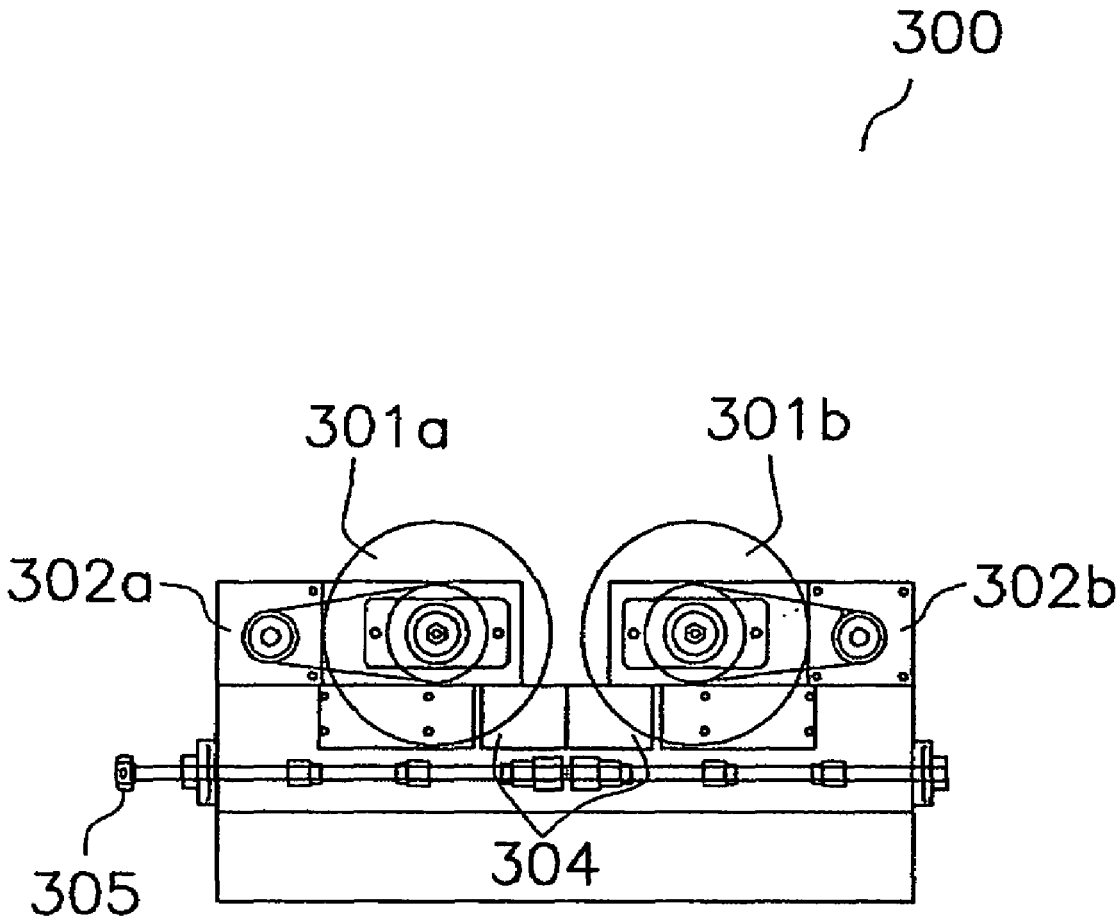

A plan view showing the rotating brush mechanism of FIG. 15.

FIG. 17

A front view describing the positioning of a chute conveyor with respect to the bag-manufacturing and packaging machine in the bag-manufacturing and packaging system pertaining to yet another embodiment of the invention.

FIG. 18

Figure 17:
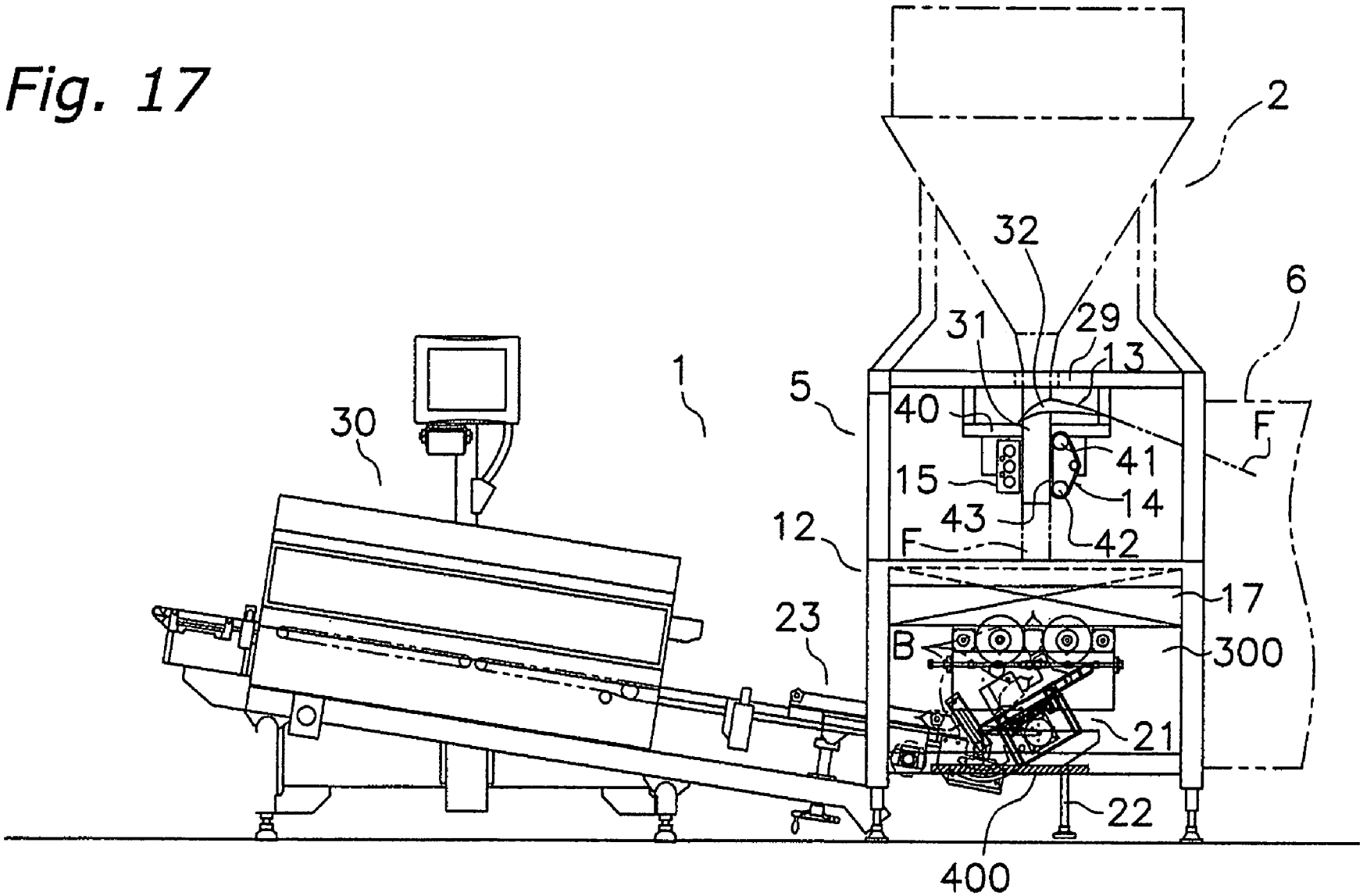

A plan view describing in detail the positioning of FIG. 17.

FIG. 19

A front view showing a rotating brush mechanism included in the bag-manufacturing and packaging system pertaining to still another embodiment of the invention.

FIG. 20

A front view showing a rotating brush mechanism included in the bag-manufacturing and packaging system pertaining to still another embodiment of the invention.

FIG. 21

Figure 20:
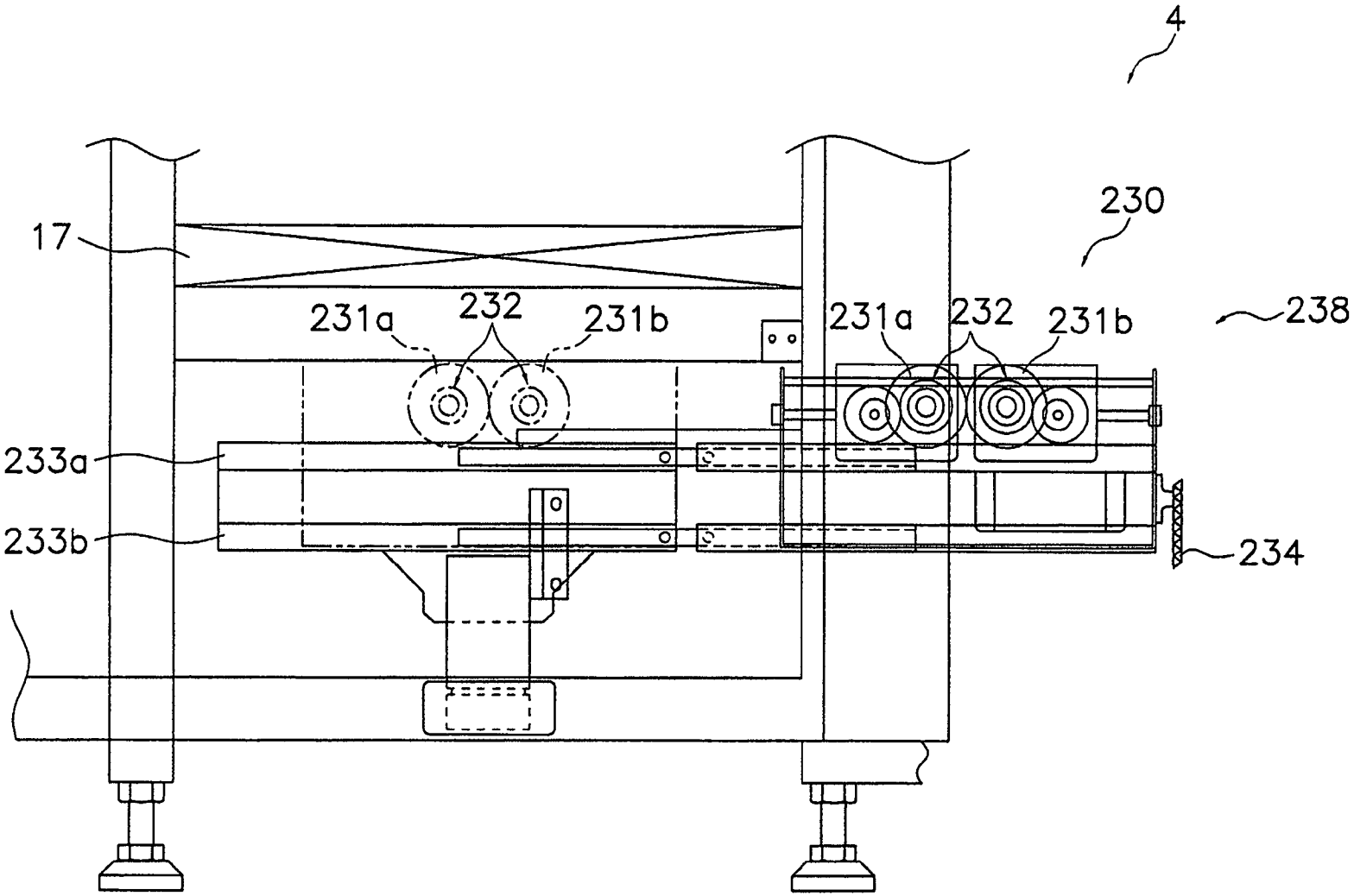

A side view of the rotating brush mechanism included in the bag-manufacturing and packaging system of FIG. 20.

FIG. 22

An enlarged view of the rotating brush mechanism included in the bag-manufacturing and packaging system of FIG. 20.

FIG. 23

A front view showing a rotating brush mechanism included in the bag-manufacturing and packaging system pertaining to still another embodiment of the invention.

FIG. 24

A front view showing a rotating brush mechanism included in the bag-manufacturing and packaging system pertaining to still another embodiment of the invention.

FIG. 25

A front view showing a rotating brush mechanism included in the bag-manufacturing and packaging system pertaining to still another embodiment of the invention.

FIG. 26

(*a*) and (*b*) are perspective views showing examples of rotors included in the bag-manufacturing and packaging system pertaining to still another embodiment of the invention.

FIG. 27

(*a*) and (*b*) are perspective views showing the configurations of cooling mechanisms included in the bag-manufacturing and packaging system pertaining to still another embodiment of the invention.

DESCRIPTION OF REFERENCE NUMERALS

1 Bag-Manufacturing and Packaging System
2 Combination Weighing Machine
3 Bag-Manufacturing and Packaging System
5 Bag-Manufacturing and Packaging Section (Vertical Bag-Manufacturing and Packaging Machine)
6 Film Supply Section
7 Operational Switches
12 Support Frame
13 Forming Mechanism
14 Pull-Down Belt Mechanism
15 Longitudinal Sealing Mechanism
17 Transverse Sealing Mechanism
20 Rotating Brush Mechanism (Pair of Rotors, Drop Orientation Control Unit)
21 Chute Conveyor (Conveyance Unit)
21*a* Flat Belt
21*b* Drive Roller
21*c* Motor
21*d* Timing Belt
21*e* Motor Box
21*f* Pivot Frame
21*g* Circular Arc Portion
21*h* Groove
21*i* Fixing Screw
22 Positioning Foot Portions
23 Transfer Conveyor
23*d* Frame
23*e* Plates
30 Seal Checker (Post-Processing Device)
31 Tube
32 Former
50*a* First Sealing Jaw Moving Unit
50*b* Second Sealing Jaw Moving Unit
51, 52 Sealing Jaws
91, 92 Drive Motors
201*a*, 201*b* Rotating Brushes (Pair of Rotors)
202, 202*a*, 202*b* Drive Motors
203 Attachment Plate
204 Adjustment Mechanism
205 Plate
205*a* Grooves
205*b* Fixing Screws
206 Guide Portions
210 Control Unit (Rotation Control Unit)
220 Rotating Brush Mechanism (Drop Orientation Control Unit)
221 Rotating Brush
223 Fixed Chute
222 Rotating Brush
230 Rotating Brush Mechanism (Drop Orientation Control Unit)
231*a* Rotating Brush
231*b* Rotating Brush
232 Cantilever Support Mechanism
233*a* Slide Rail
233*b* Slide Rail
234 Lever
235*a* Fitting Portion
235*b* Fitting Portion
236 Male Screw
237 Female Screw
238 Pullout Mechanism
240 Multiple Rotating Brush (Multiple Rotor, Drop Orientation Control Unit)
241*a* Rotating Brush Group (Rotors)
241*b* Rotating Brush Group (Rotors)
251 Rotating Brush (Rotor)
252 Rotating Brush (Rotor)
252*a* Both End Portions
252*b* Center Portion
253 Rotating Brush Mechanism (Drop Orientation Control Unit)
253*a* Rotating Brushes (Rotors)
253*b* Air Nozzle (Cooling Mechanism)
254 Rotating Brush Mechanism (Drop Orientation Control Unit)
254*a* Rotating Brush (Rotor)
254*b* Air Blowout Ports (Cooling Mechanism)
300 Rotating Brush Mechanism
301*a*, 301*b* Rotating Brushes (Pair of Rotors)
302*a*, 302*b* Drive Motors
303*a*, 303*b* Air Cylinders (Rotor Interval Adjustment Unit)
304 Regulation Blocks
305 Adjustment Screw
310 Control Unit (Interval Control Unit)
400 Positioning Plates
B Bag
X Distance (Length of One Bag)

BEST MODES FOR IMPLEMENTING THE INVENTION

First Embodiment

The bag-manufacturing and packaging system pertaining to an embodiment of the invention will now be described using FIGS. 1 to 12.

[Overall Configuration of Bag-Manufacturing and Packaging System 1]

The bag-manufacturing and packaging system 1 of the present embodiment is a system that includes a vertical bag-manufacturing and packaging section (vertical bag-manufacturing and packaging machine) 5 shown in FIG. 1, which bags contents such as potato chips, and various units shown in FIG. 2 disposed downstream of the vertical bag-manufacturing and packaging section 5. The bag-manufacturing and packaging system 1 mainly includes the bag-manufacturing and packaging section 5, which is the main portion that bags contents, a film supply section 6 that supplies film that becomes bags to the bag-manufacturing and packaging section 5, a rotating brush mechanism (pair of rotors, drop orientation control unit) 20, a chute conveyor (conveyance unit) 21, a transfer conveyor 23, and a seal checker 30 that inspects bags B manufactured in the bag-manufacturing and packaging section 5. Operational switches 7 are disposed on a front surface of the bag-manufacturing and packaging section 5, and a liquid crystal display 8 that displays an operational status is disposed at a position viewable by an operator operating the operational switches 7.

<Configuration of the Film Supply Section and the Bag-Manufacturing and Packaging Section>

The film supply section 6 fulfills the role of supplying sheet-like film to a forming mechanism 13 of the bag-manufacturing and packaging section 5. Here, the film supply section 6 is disposed adjacent to the bag-manufacturing and packaging section 5. A roll of film is set in the film supply section 6, and the film is unwound from the roll.

As shown in FIGS. 1 and 2, the bag-manufacturing and packaging section 5 includes the forming mechanism 13 that forms the film sent in sheet form into a tubular form, a pull-down belt mechanism 14 that conveys the tubular-formed film (hereinafter called "tubular film") downward, a longitudinal sealing mechanism 15 that longitudinally heat-seals the overlapping portion of the tubular film, a transverse sealing mechanism 17 that transversely seals the tubular film to close the top and bottom ends of a bag B, and a support frame 12 that supports these mechanisms. A casing 9 is installed around the support frame 12.

As shown in FIG. 2, the forming mechanism 13 includes a tube 31 and a former 32. The tube 31 is a cylindrical member that is open at its upper and lower ends. The tube 31 is disposed at an open portion in a ceiling plate 29, which open portion is located in the vicinity of the center of the ceiling plate 29 when seen in plan view, and is integrated with the former 32 via an unillustrated bracket. Contents weighted by a combination weighing machine 2 are delivered to the open portion at the upper end of the tube 31. The former 32 is disposed so as to surround the tube 31. The former 32 is shaped such that the sheet-like film F fed from the film supply section 6 is formed into a tubular form as it passes between the former 32 and the tube 31. The former 32 is also fixed to the support frame 12 via an unillustrated support member. The tube 31 and the former 32 of the forming mechanism 13 are configured such that they can be replaced in accordance with the width dimension of the bag B to be manufactured. For this reason, the forming mechanism 13 is configured to be attachable to, and detachable from, the support frame 12.

The pull-down belt mechanism 14 and the longitudinal sealing mechanism 15 are supported by a rail 40 hanging down from the ceiling plate 29, and disposed so as to sandwich the tube 31 from both sides. These mechanisms 14 and 15 are moved along the rail 40 and positioned when the tube 31 is installed. The pull-down belt mechanism 14 is a mechanism that by suction holds the tubular film F wrapped onto the tube 31, and conveys the film downward. The pull-down belt mechanism 14 mainly comprises a drive roller 41, a driven roller 42, and a belt 43 that has a suction-holding function. The longitudinal sealing mechanism 15 is a mechanism that longitudinally seals the overlapping portion of the tubular film, which is wrapped onto the tube 31, by applying heat while pressing the tubular film against the tube 31 with a constant pressure. The longitudinal sealing mechanism 15 includes a heater and a heated belt or the like that is heated by the heater and contacts the overlapping portion of the tubular film.

<Configuration of the Transverse Sealing Mechanism>

Next, the transverse sealing mechanism 17 will be described.

Figure 4:
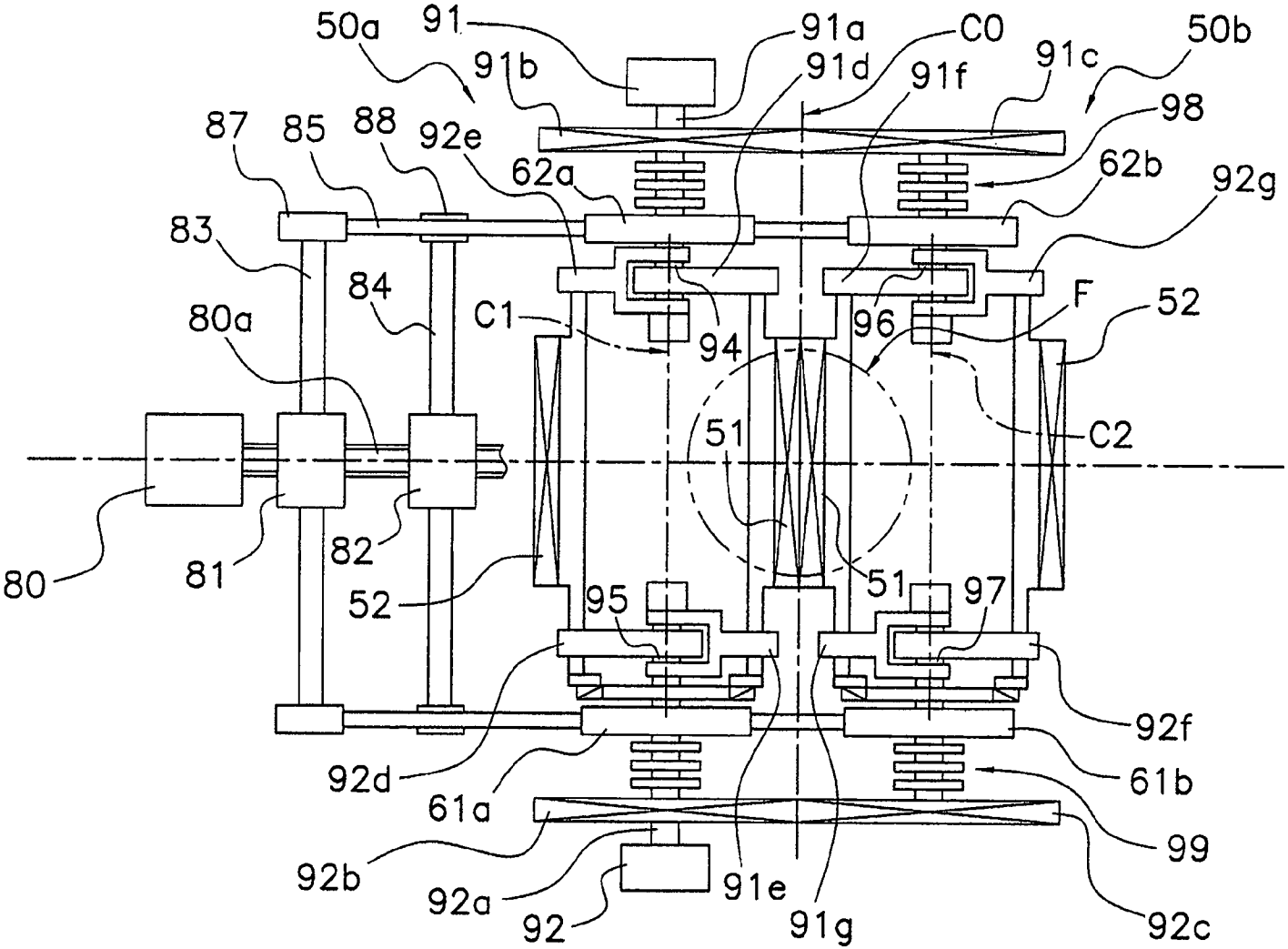

The transverse sealing mechanism 17 is disposed below the forming mechanism 13, the pull-down belt mechanism 14 and the longitudinal sealing mechanism 15, and is supported by the support frame 12. As shown in FIGS. 3 and 4, the transverse sealing mechanism 17 includes left and right sealing jaw moving units 50*a* and 50*b*. The sealing jaw moving units 50*a* and 50*b* are units that each revolves two sealing jaws 51 and 52 in a "D" shape. When transversely sealing the tubular film, the two sealing jaw moving units 50*a* and 50*b* press the pair of sealing jaws 51 or the pair of sealing jaws 52 together. Below, the sealing jaw moving unit positioned at the left side of the tubular film F in FIGS. 3 and 4 will be called the first sealing jaw moving unit 50*a*, while the sealing jaw moving unit positioned at the right side will be called the second sealing jaw moving unit 50*b*. The tubular film F is conveyed downward along a plane C0 that separates the two sealing jaw moving units 50*a* and 50*b*, such that the plane C0 is at the width-direction center of the tubular film F.

Each of the sealing jaw moving units 50*a* and 50*b* has a sealing jaw 51 and a sealing jaw 52. The sealing jaw moving units 50*a* and 50*b* use the same drive motor for driving their sealing jaws 51 and another drive motor for driving their sealing jaws 52. The sealing jaws 51 are driven by a drive motor 91 so as to rotate around axes C1 and C2. Namely, the sealing jaw 51 of the first sealing jaw moving unit 50*a* rotates around axis C1 and the sealing jaw 51 of the second sealing jaw moving unit 50*b* rotates around axis C2. The sealing jaws 52 are driven by a drive motor 92 so as to rotate around the axes C1 and C2. Namely, the sealing jaw 52 of the first sealing jaw moving unit 50*a* rotates around axis C1 and the sealing jaw 52 of the second sealing jaw moving unit 50*b* rotates around axis C2.

The drive motor 91 rotates gears 91*b* and 91*c*, and the rotation of the gears 91*b* and 91*c* is transmitted through a Schmidt coupling 98 to revolution shafts 94 and 96, which are coaxial with respect to the axes C1 and C2 of the sealing jaw moving units 50*a* and 50*b*. One end of a lever 91*d* is fixed to the revolution shaft 94 and one end of another level 91*f* is fixed to the revolution shaft 96. Thus, the levers 91*d* and 91*f* respectively rotate around the revolution centers C1 and C2.

The drive motor 92 rotates gears 92*b* and 92*c*, and the rotation of the gears 92*b* and 92*c* is transmitted through a Schmidt coupling 99 to revolution shafts 95 and 97, which are coaxial with respect to the revolution axes C1 and C2 of the sealing jaw moving units 50*a* and 50*b*. One end of a lever 92*d* is fixed to the revolution shaft 95 and one end of another lever 92*f* is fixed to the revolution shaft 97. Thus, the levers 92*d* and 92*f* respectively rotate around the revolution axes C1 and C2.

The sealing jaw 51 of the first sealing jaw moving unit 50*a* is supported at one end by the tip end of the lever 91*d* and at the other end by the tip end of a lever 91*e*. The lever 91*e* is a member that rotates around the revolution axis C1 and is supported such that it can rotate relative to the revolution shaft 95.

The sealing jaw 51 of the second sealing jaw moving unit 50*b* is supported at one end by the tip end of the lever 91*f* and at the other end by the tip end of a lever 91*g*. The lever 91*g* is a member that rotates around the revolution axis C2 and is supported such that it can rotate relative to the revolution shaft 97.

The sealing jaw 52 of the first sealing jaw moving unit 50*a* is supported at one end by the tip end of the lever 92*d* and at the other end by the tip end of a lever 92*e*. The lever 92*e* is a member that rotates around the revolution axis C1 and is supported such that it can rotate relative to the revolution shaft 94.

The sealing jaw 52 of the second sealing jaw moving unit 50*b* is supported at one end by the tip end of the lever 92*f* and at the other end by the tip end of a lever 92*g*. The lever 92*g* is a member that rotates around the revolution axis C2 and is supported such that it can rotate relative to the revolution shaft 96.

The sealing jaws 51 and 52 are members that are longer in the vertical direction of FIG. 4 than the width of the tubular film F, and include internal heaters. The sealing surfaces of the sealing jaws 51 and 52 are heated by the heaters such that part of the tubular film F is thermally sealed when sandwiched between the left and right sealing jaws 51 and 52.

Each of the Schmidt couplings 98 and 99 includes three circular disks joined by links. The Schmidt couplings 98 and 99 serve as a shaft coupling that transmits the rotation of an input shaft to an output shaft. The Schmidt couplings 98 and 99 are configured such that they can transmit the rotation of the input shaft to the output shaft even in situations where the output shaft moves in a planar manner with respect to the planarly fixed input shaft such that the distance between the shafts changes.

Figure 5:
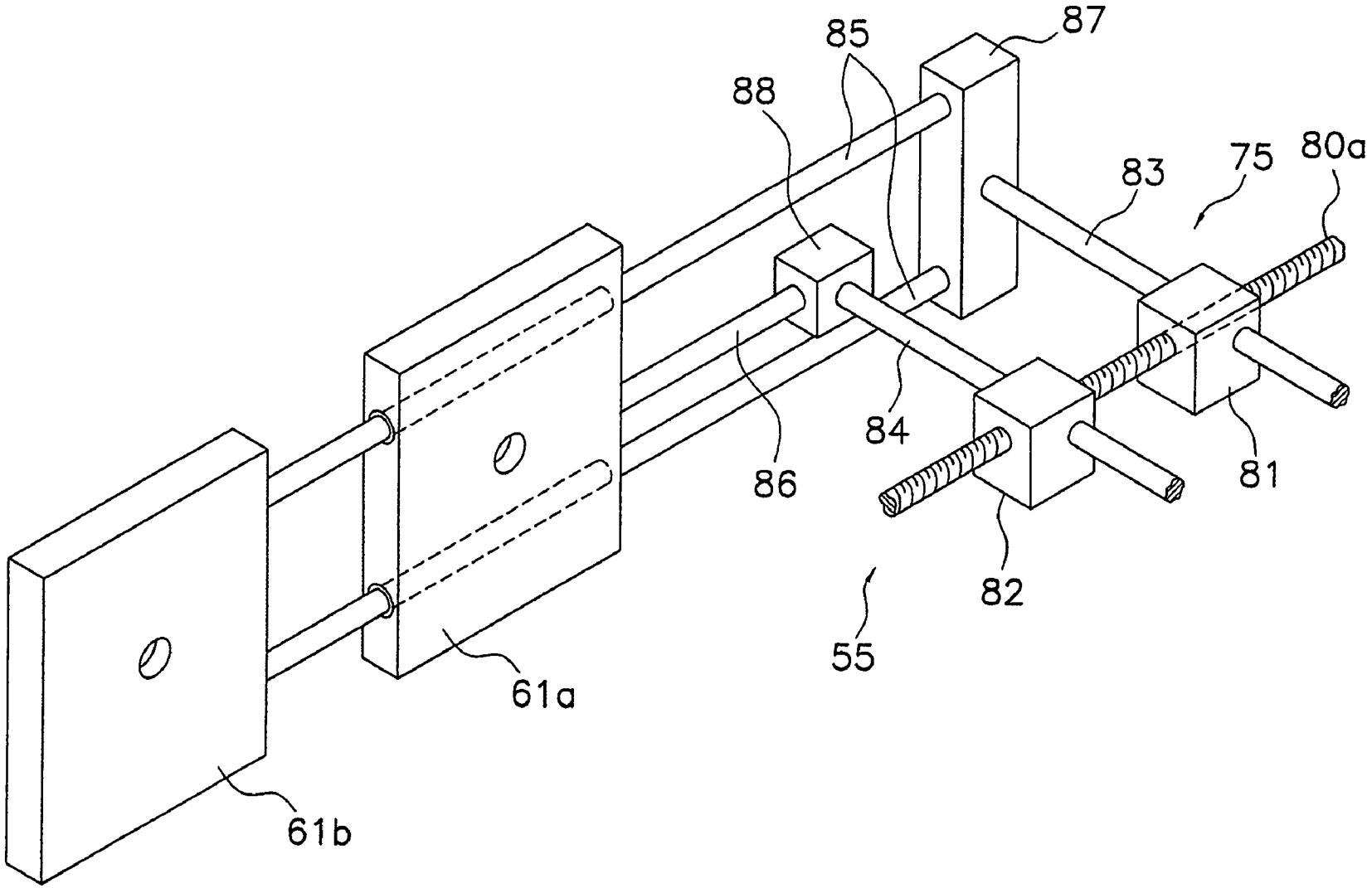

The revolution shafts 94, 95, 96 and 97 are turnably supported by horizontal movement plates 62*a*, 61*a*, 62*b* and 61*b*, respectively. The horizontal movement plates 62*a*, 61*a*, 62*b* and 61*b* are moved horizontally by a sideways drive mechanism 55 shown in FIG. 5. The horizontal movement plates 61*a* and 62*a* move together in the same manner, while the horizontal movement plates 61*b* and 62*b* move together in the same manner. Here, the sideways drive mechanism 55 will be described with reference to the horizontal moving plates 61*a* and 61*b*. As shown in FIG. 5, the sideways drive mechanism 55 includes a drive mechanism 75, for moving the horizontal movement plates 61*a* and 61*b* closer together or apart, and guide portions or guide rails that support the horizontal movement plates 61*a* and 61*b* such that they can slide freely in the horizontal direction.

The drive mechanism 75 includes a ball screw 80*a* rotated by a servo motor 80 (see FIG. 3), first and second nut members 81 and 82 that threadedly engage with the ball screw 80*a*, first and second linking rods 83 and 84 that are disposed so as to intersect the ball screw 80*a* in the horizontal direction, a pair of third linking rods 85 disposed along the movement direction, and a fourth linking rod 86 disposed parallel to the third linking rods 85.

The first linking rod 83 is linked to the pair of third linking rods 85 through a coupling 87. The tips of the two third linking rods 85 are fixed to a lateral end face of the horizontal movement plate 61*b*. The two third linking rods 85 pass through the horizontal movement plate 61*a* such that they can slide freely through the horizontal movement plate 61*a*. The second linking rod 84 is linked to the fourth linking rod 86 through a coupling 88. The tip of the fourth linking rod 86 is fixed to a lateral end face of the horizontal movement plate 61*a*.

In the ball screw 80*a*, the portion of the ball screw 80*a* that mates with the first nut member 81 and the portion that mates with the second nut member 82 have opposite threads.

Thus, by rotating the ball screw 80*a* of the drive mechanism 75, the horizontal movement plates 61*a* and 61*b* can be made to approach each other or separate from each other.

<Operation of the Bag-Manufacturing and Packaging Section Prior to the Transverse Sealing Operation>

Next, the operation of the bag-manufacturing and packaging system 1 will be described.

First, the operation of the bag-manufacturing and packaging system 1 prior to the transverse sealing operation will be described on the basis of FIG. 2.

The sheet-like film F delivered to the forming mechanism 13 from the film supply section 6 is wrapped onto the tube 31 from the former 32 and formed into a tubular shape. The pull-down belt mechanism 14 conveys the tubular film downward as is. Then, while the film F is wrapped onto the tube 31, the two end portions thereof overlap on the circumferential surface of the tube 31, and the overlapping portion is longitudinally sealed by the longitudinal sealing mechanism 15.

After the cylindrically-shaped tubular film F is sealed longitudinally, it leaves the tube 31 and moves down to the transverse sealing mechanism 17. Simultaneously with the movement of the tubular film F, the combination weighing machine 2 drops a mass of contents through the tube 31 and into the tubular film F. Then, the transverse sealing mechanism 17 thermally seals a transverse portion that corresponds to the top end of the bag B containing the contents and the bottom end of the subsequent bag B thereabove.

<Operation of the Bag-Manufacturing and Packaging System after the Transverse Sealing Operation>

Figure 6:
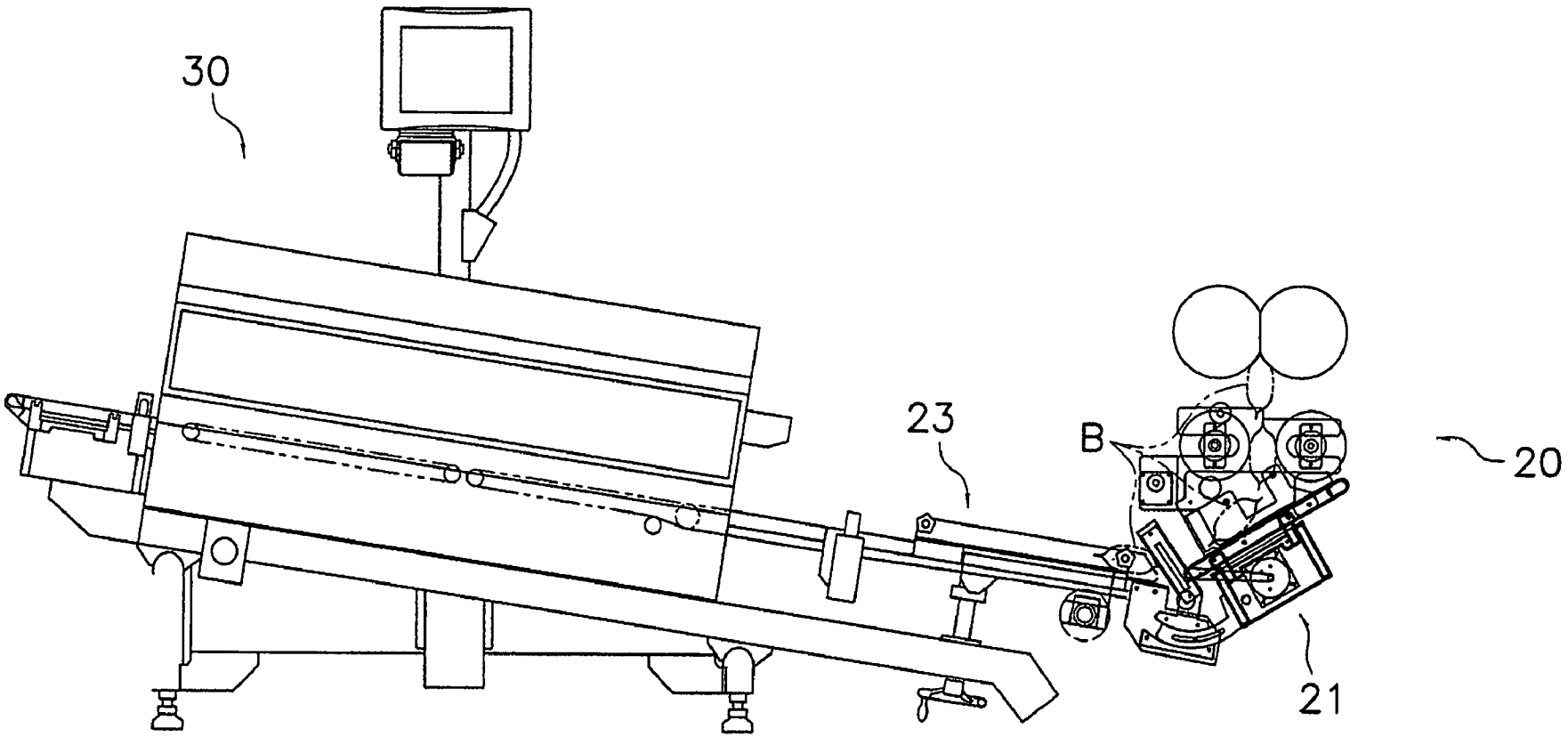

As shown in FIGS. 2 and 6, bags B made in a continuous manner as described above are dropped from the transverse sealing mechanism 17 onto a chute conveyor 21 via a rotating brush mechanism 20 (see the drop point shown in FIG. 7), conveyed downstream in the conveyance direction by the chute conveyor 21, and are delivered to a device of a later process (post-processing device) such as the seal checker 30 through the transfer conveyor 23.

<Configuration of the Rotating Brush Mechanism>

As shown in FIG. 7, the bag-manufacturing and packaging system 1 of the present embodiment is disposed with the rotating brush mechanism 20 between the transverse sealing mechanism 17 and the chute conveyor 21 of the bag-manufacturing and packaging section 5.

Figure 8:
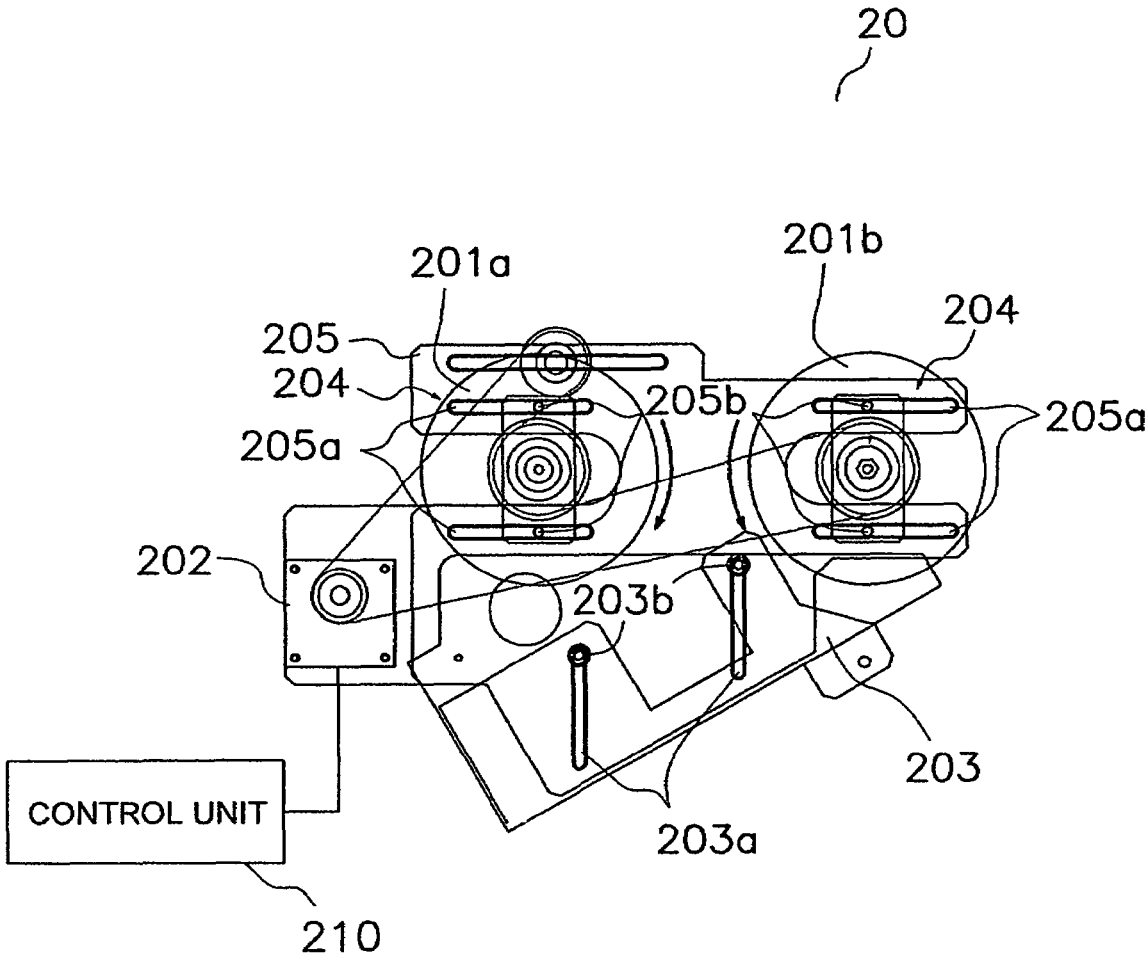
Figure 9:
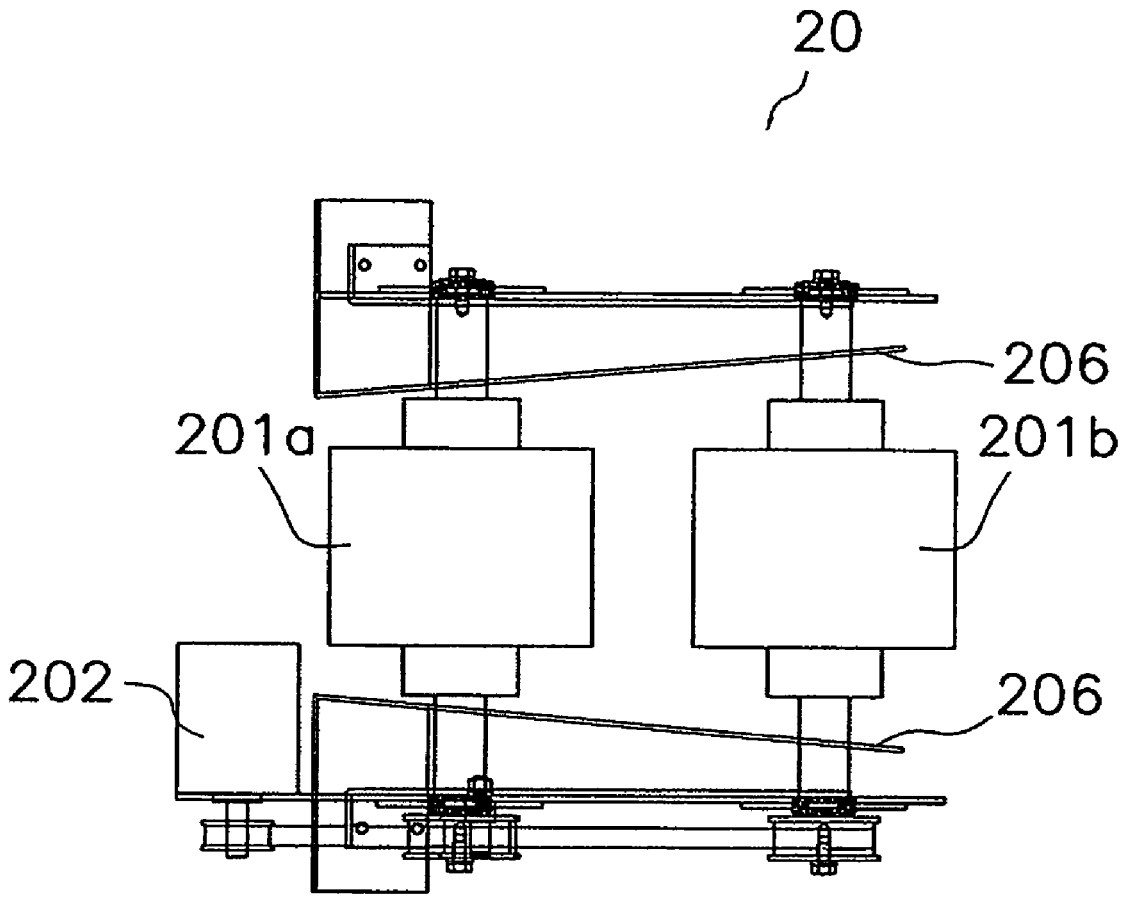

As shown in FIG. 7, the rotating brush mechanism 20 includes a pair of rotating brushes 201*a* and 201*b*, which rotate in the directions of the arrows shown in FIG. 8 around their respective rotational axes, a drive motor 202, which rotatably drives the rotating brushes 201*a* and 201*b*, and guide portions 206 (see FIG. 9). The rotating brush mechanism 20 is fixed by an attachment plate 203 to the chute conveyor 21. The attachment plate 203 is fixed by fixing screws 203*b* that are screwed into portions of grooves 203*a*. By loosening the fixing screws 203*b* and moving the attachment plate 203 along the grooves 203*a*, the distance between the rotating brush mechanism 20 and the conveyance surface of the chute conveyor 21 can be adjusted. Assuming that X represents the length of one bag in the conveyance direction, the rotating brush mechanism 20 is disposed such that it is separated downward from the transverse sealing mechanism 17 by the distance X and separated upward from the drop position on the chute conveyor 21 by the distance X. In other words, the rotating brush mechanism 20 is disposed at an intermediate position between the transverse seal mechanism 17 and the chute conveyor 21. When the bag B is discharged from the transverse sealing mechanism 17, the bag B contacts the rotating brush mechanism 20 at substantially the same time as when it separates from the transverse sealing mechanism 17. Similarly, the bag B contacts the chute conveyor 21 at substantially the same time as when it is discharged from the rotating brush mechanism 20. For this reason, the delivery of the bag B can be conducted smoothly without imparting shock to the bag B.

Figure 11:
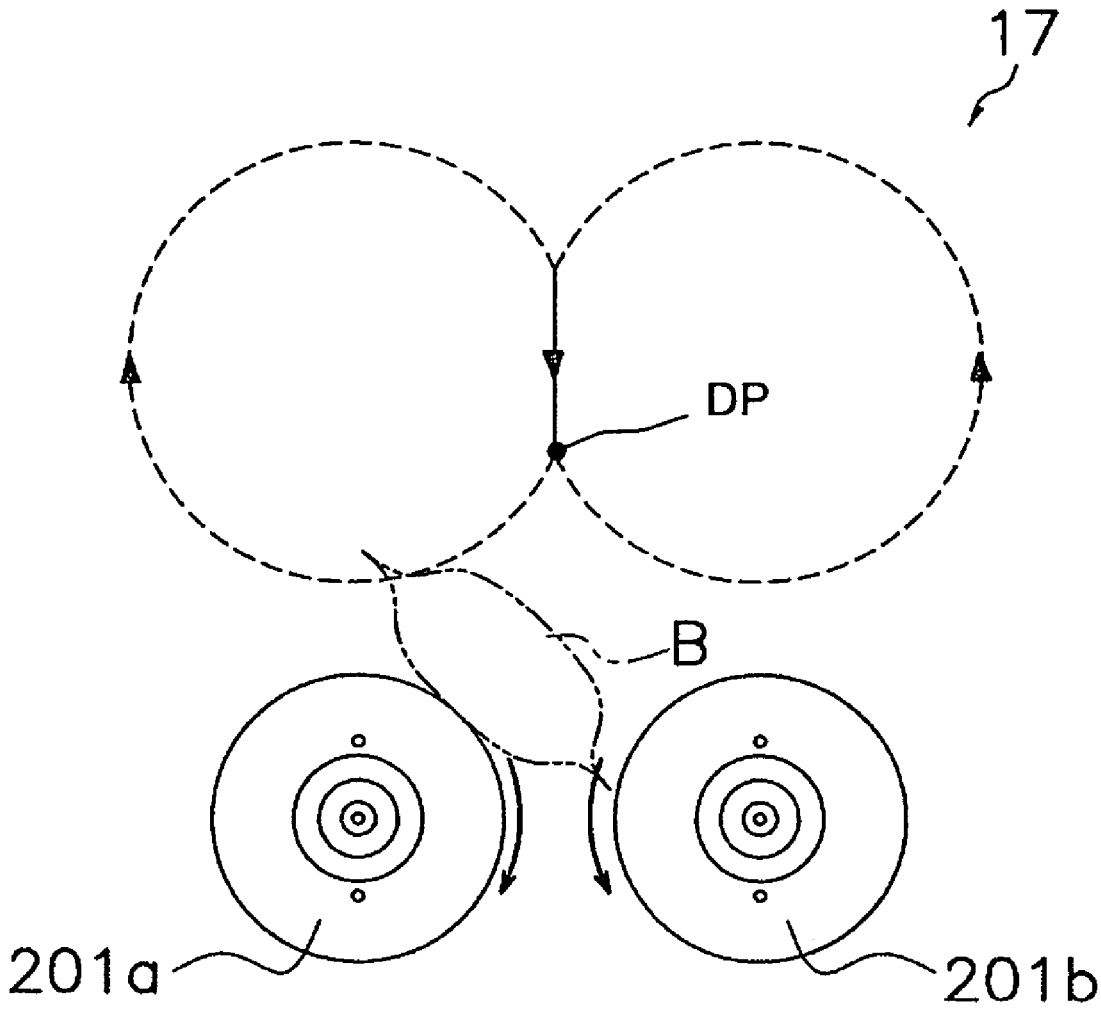

As shown in FIG. 7, the pair of rotating brushes 201*a* and 201*b* are disposed such that their rotational axes are horizontal. The pair of rotating brushes 201*a* and 201*b* guide the bag, which is fed in a state where it hangs down from the seal portion at its upper end in the transverse sealing mechanism 17, between the rotating brushes 201*a* and 201*b* such that the bag B is sandwiched from both sides, and cause the bag B to drop to a predetermined position on the chute conveyor 21 (see the drop position shown in FIG. 7). The rotating brushes 201*a* and 201*b* are of the same size and rotate such that the tip end portions of the brushes follow circular trajectories around the rotational axes. For this reason, as shown in FIG. 11, even if the bag B clings to one of the sealing jaws 51 and 52 of the transverse sealing mechanism 17 and does not drop to the center portion between the rotating brushes 201*a* and 201*b*, the bag B can be guided between the rotating brushes 201*a* and 201*b* wrapped around between the rotating brushes 201*a* and 201*b* as long as it is within an inner range from the top portion vicinity of the rotating brushes 201*a* and 201*b*. The case where the bag B does not drop to the center portion between the rotating brushes 201*a* and 201*b* means a case where the bag B is dropped being displaced towards the rotating brush 201*a* or the rotating brush 201*b*, or toward the rotational axes direction of the rotating brushes 201*a* and 201*b*. Moreover, the pair of rotating brushes 201*a* and 201*b* rotate at the same speed as, or at a slightly faster speed than, the speed at which the bag B is manufactured in the bag-manufacturing and packaging section 5, so that the bags B do not accumulate in the rotating brush mechanism 20. The pair of rotating brushes 201*a* and 201*b* are disposed such that the interval therebetween is slightly narrower than the thickness of the bag B, and include an adjustment mechanisms 204 for adjusting the distance between the rotating brushes 201*a* and 201*b* in accordance with the thickness of the bag B.

The rotating brushes 201*a* and 201*b* actually include brush portions that extend in the radial direction around the rotational axes. However, for convenience of description, the drawings show simple circles. For this reason, the bag B, which is conveyed so as to be sandwiched between the rotating brushes 201*a* and 201*b*, is fed to the chute conveyor 21 while receiving appropriate pressure from both sides due to the elasticity of the brush portions.

As shown in FIG. 8, the drive motor 202 rotatably drives both of the rotating brushes 201*a* and 201*b* through a belt. The drive motor 202 is connected to a control unit (rotation control unit) 210, and the rotational speed of the drive motor 202 is controlled by the control unit 210 in accordance with the running speed of the bag-manufacturing and packaging section 5.

Each of the adjustment mechanisms 204 includes grooves 205*a*, which are formed in a plate 205 that supports the rotating brushes 201*a* and 201*b* from their lateral faces, and fixing screws 205*b*. By moving the rotating brushes 201*a* and 201*b* along the grooves 205*a* and fixing the rotating brushes 201*a* and 201*b* at predetermined positions using the fixing screws 205*b*, the distance between the rotating brushes 201*a* and 201*b* can be changed.

As shown in FIG. 9, the guide portions 206 are plates that regulate the moving direction of the bag B such that the bag B dropping from the transverse sealing mechanism 17 (see FIG. 7) does not deviate from the rotational axes directiona of the rotating brushes 201*a* and 201*b* of the rotating brush mechanism 20. The interval between the guide portions 206 can be adjusted in accordance with the size of the bag B and the width-direction length of the rotating brushes 201*a* and 201*b*.

<Configuration of the Chute Conveyor>

Figure 10:
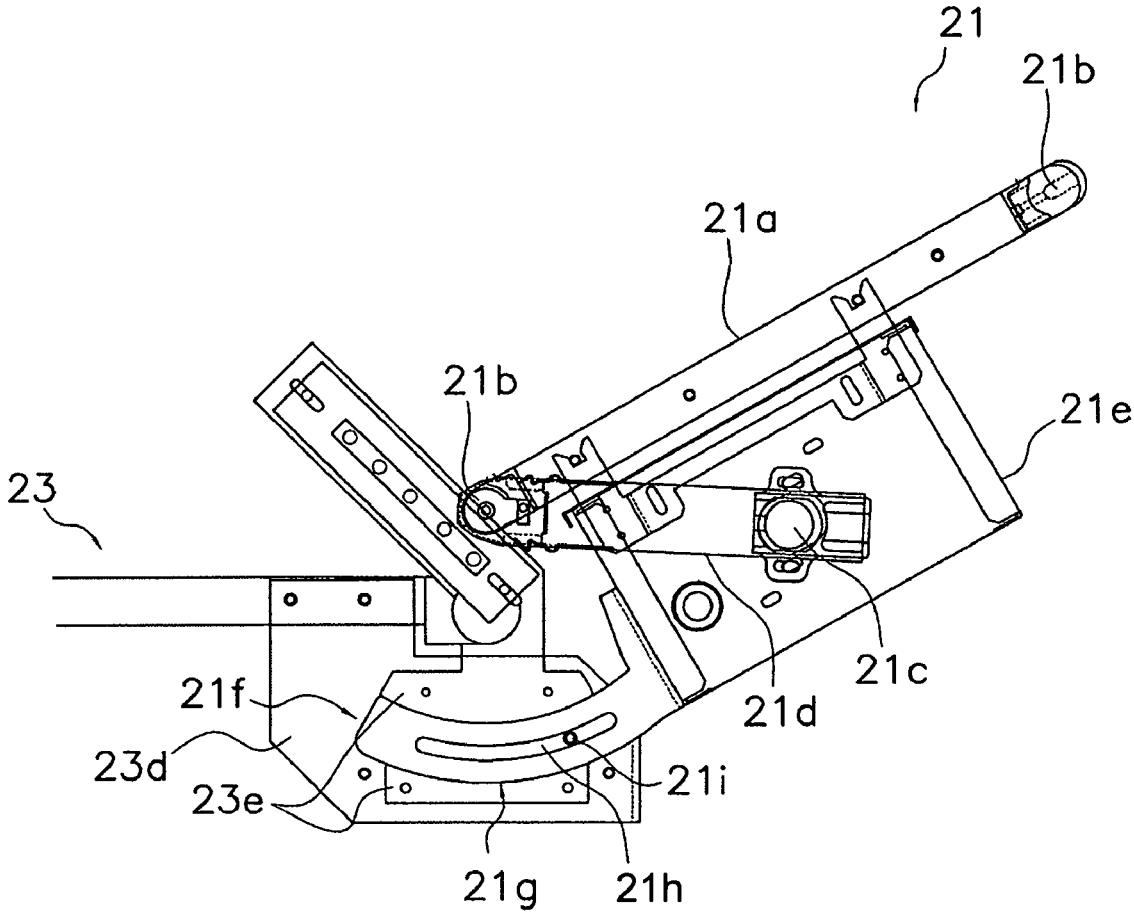

As shown in FIG. 2, the chute conveyor 21 is disposed directly below the rotating brush mechanism 20, receives the dropped bag in a state where the angle of the conveyance surface of the chute conveyor 21 is set to about 30 degrees, and conveys the bag downstream. As shown in FIG. 10, the chute conveyor 21 includes an endless flat belt 21 a that conveys objects, drive rollers 21*b* that support the flat belt 21*b* from its inner side, a motor 21*c* that generates a rotational drive force, and a timing belt 21*d*. The chute conveyor 21 conveys objects placed on the flat belt 21*a* in a desired direction as a result of the rotational drive force of the motor 21*c* being transmitted to the drive rollers 21*b* via the timing belt 21*d* and the flat belt 21*a* rotating.

The chute conveyor 21 also includes a motor box 21*e*, which houses the motor 21*c* and the like inside, and a pivot frame 21*f*, which is attached downstream of the motor box 21*e*.

The pivot frame 21 f includes a circular arc portion 21*g* that is pivotably supported between two plates 23*e* attached to a frame 23*d* of the transfer conveyor 23. The circular arc portion 21*g* is a plate member formed to include two circular arcs whose radii around the rotational axis of the downstream drive roller 21*b* are different. A groove 21*h* parallel to the two circular arcs is formed in the circular arc portion 21*g*. A fixing screw 21*i* that is mated with a female screw hole formed in the frame 23*d* of the transfer conveyor 23 is inserted into the groove 21*h*, and the pivot frame 21*f* is fixed to the frame 23*d* of the transfer conveyor 23, which is disposed downstream, by tightening the fixing screw 21*i* at a desired position. Thus, by moving the circular arc portion 21*g* between the two plates 23*e* and fixing the circular arc portion 21*g* with the fixing screw 21*i*, the entire chute conveyor 21 can be pivoted using the rotational axis of the downstream drive roller 21*b* as a hypothetical pivot axis, and the angle of the chute conveyor 21 and the height of upstream end portion can be adjusted. For this reason, the reception angle of the chute conveyor 21, and the distance between the drop position of the bag on the chute conveyor 21 and the rotating brush mechanism 20, can be easily adjusted in accordance with the size and shape of the bag dropped from the rotating brush mechanism 20. Thus, the bag dropped from the rotating brush mechanism 20 can be prevented from rolling forward, and the bag can be smoothly conveyed downstream while maintaining a constant orientation.

<Characteristics of the Bag-Manufacturing and Packaging System 1 of the Present Embodiment>

(1)

As shown in FIG. 7, the bag-manufacturing and packaging system 1 of the present embodiment includes the rotating brush mechanism 20 that is disposed between traverse sealing mechanism 17 and the chute conveyor 21 of the bag-manufacturing and packaging section 5, to sandwich the bag B fed from the transverse sealing mechanism 17 between the two rotating brushes 201*a* and 201*b*, and convey the bag B to the chute conveyor 21.

Thus, as shown in FIG. 11, even if the discharge position of the bag B in the transverse sealing mechanism 17 is displaced from the predetermined discharge position DP the rotating brushes 201*a* and 201*b* both rotate to wrap the bag B inward, so that the bag B can be reliably guided between the rotating brushes 201*a* and 201*b* as long as the drop position of the bag B is within the reach of the rotating brushes 201*a* and 201*b* from the top portion of the rotating brushes 201*a* and 201*b*. Thus, the bag B can be fed to a predetermined position on the chute conveyor 21. As a result, disturbances in the pitch of the bag B on the chute conveyor 21 resulting from variations (throwing of the bag B) in the discharge position in the transverse sealing mechanism 17 can be prevented, and the bags B can be prevented from accumulating on the chute conveyor 30 disposed downstream. Moreover, the bag B can be conveyed to the chute conveyor 21 at a stable speed and with a stable orientation.

Figure 12:
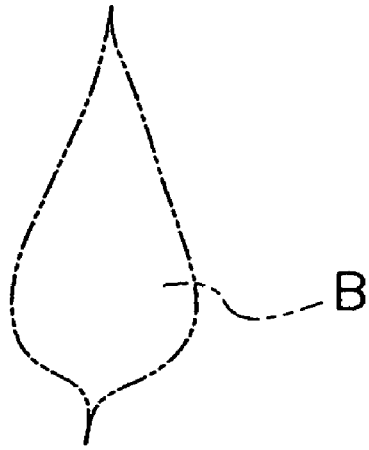
Figure 12:
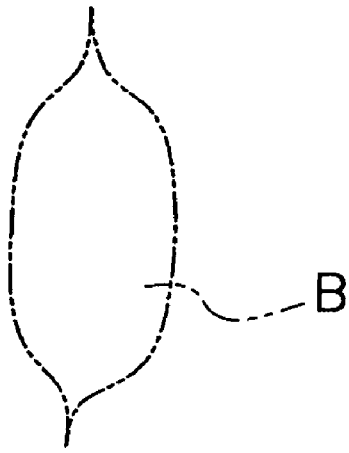

Also, because the bag B is conveyed while being sandwiched between two rotors such as the rotating brushes 201*a* and 201*b*, the bag B can be conveyed in a state where appropriate pressure is applied to the bag B from both sides. Thus, the bag B, in the bottom of which items tend to settle as shown in FIG. 12(*a*) because the bag B is conveyed being hung down from the transverse sealing mechanism 17, can be evened out, and the thickness of the bag B can be made uniform as shown in FIG. 12(*b*). Furthermore, it is easy for the bag B to rotate and/or topple over after being dropped to the chute conveyor 21 if items pile up in the bottom of the bag B, which is being hung down from the transverse sealing mechanism 17, because the bottom of the bag B becomes thicker as shown in FIG. 12(*a*). However, in the present embodiment, because the bag B is conveyed to the chute conveyor 21 after being evened out by the two rotating brushes 201*a* and 201*b*, the aforementioned problem can be eliminated and the bag B can be smoothly conveyed.

(2)

In the bag-manufacturing and packaging system 1 of the present embodiment, the rotating brushes 201*a* and 201*b* include brushes that extend in the radial direction around the rotational axes. For this reason, the rotating brushes 201*a* and 201*b* have elasticity in the radial direction around the rotational axes.

Thus, even when the rotating brushes 201*a* and 201*b* sandwich and convey the bag B, the bag B can be conveyed to the chute conveyor 21 while evening out the bag B in a state where appropriate pressure is applied thereto, without damaging the contents of the bag B (e.g., potato chips, etc.). Also, because the rotating brushes 201*a* and 201*b* are elastic, it becomes unnecessary to strictly set the interval between the rotating brushes 201*a* and 201*b* each time the size of the bag B changes.

(3)

In the bag-manufacturing and packaging system 1 of the present embodiment, the rotating brush mechanism 20 includes the adjustment mechanisms 204 that adjust the distance between the rotating brush 201*a* and the rotating brush 201*b*, as shown in FIG. 8.

Thus, the distance between the rotating brushes can be adjusted to a desired interval in accordance with the size of the bag B to be manufactured in the bag-manufacturing and packaging section 5. Thus, the bag B can be conveyed between the rotating brushes 201*a* and 201*b* in a state where appropriate pressure is applied to the bag B.

(4)

In the bag-manufacturing and packaging system 1 of the present embodiment, the rotational speed of the rotating brushes 201*a* and 201*b* is controlled by the control unit 210 connected to the drive motor 202 that rotatably drives the rotating brushes 201*a* and 201*b*, as shown in FIG. 8.

Thus, the rotational speed of the rotating brushes 201*a* and 201*b* can be controlled to be an appropriate rotational speed in accordance with the running ability of the bag-manufacturing and packaging section 5 and the type of contents of the bag B.

(5)

In the bag-manufacturing and packaging system 1 of the present embodiment, the two rotating brushes 201*a* and 201*b* are of the same size and disposed so that their rotational axes are horizontal, as shown in FIG. 7.

Thus, the bag B to be discharged from the transverse sealing mechanism 17 can be discharged directly downward (in the vertical direction). Thus, the bag B can be dropped directly downward to the chute conveyor 21 and stably conveyed on the chute conveyor 21.

(6)

In the bag-manufacturing and packaging system 1 of the present embodiment, the rotating brush mechanism 20 is disposed so as to be below and apart from the transverse sealing mechanism 17 by the distance X, which is equal to the length of one bag B, as shown in FIG. 7.

Thus, the bag B can be sandwiched and conveyed between the rotating brushes 201*a* and 201*b* at substantially the same time as when the bag B discharged from the transverse sealing mechanism 17 is separated from the sealing jaws 51 and 52. Thus, the bag B can be stably conveyed in the rotating brush mechanism 20 from the transverse sealing mechanism 17.

(7)

In the bag-manufacturing and packaging system 1 of the present embodiment, the rotating brush mechanism is disposed so as to be above and apart from the chute conveyor 21 by the distance X, which is equal to the length of one bag B, as shown in FIG. 7.

Thus, the bag B can be made to contact the conveyance surface of the chute conveyor 21 at substantially the same time as when the bag B discharged from the rotating brush mechanism 20 is separated from the rotating brushes 201*a* and 201*b*. Thus, the bag B can be stably conveyed on the chute conveyor 21 from the rotating brush mechanism 20 without imparting shock to the bag B.

(8)

In the bag-manufacturing and packaging system 1 of the present embodiment, the transverse sealing mechanism 17 of the bag-manufacturing and packaging section 5 includes the sealing jaws 51 and 52 driven in a substantial "D" shape.

Ordinarily, in a transverse sealing mechanism 17 having rotary-type sealing jaws 51 and 52, sometimes the seal portion of the bag B clings to one of the sealing jaws after being sealed, and the bag B drops after moving together with the sealing jaw. For this reason, in the present embodiment, if the drop position of the bag B becomes displaced in this manner, the bag B can be guided so as to be taken to between the rotating brushes 201*a* and 201*b* due to the rotation of the rotating brushes 201*a* and 201*b*. Thus, even if the bag B clings to one of the sealing jaws 51 and 52, the bag B can be reliably guided in between the rotating brushes 201*a* and 201*b* and conveyed to a predetermined position on the chute conveyor 21. Thus, disturbances in the pitch of the bag B on the chute conveyor 21 can be eliminated, and the bag B can be smoothly conveyed.

(9)

In the bag-manufacturing and packaging system 1 of the present embodiment, the rotating brush mechanism 20 is disposed at an intermediate position between the transverse sealing mechanism 17 and the chute conveyor 21, as shown in FIG. 7.

Thus, the bag B can be stably conveyed between the transverse sealing mechanism 17 and the rotating brush mechanism 20, and between the rotating brush mechanism 20 and the chute conveyor 21.

(10)

In the bag-manufacturing and packaging system 1 of the present embodiment, the chute conveyor 21 is pivotable around the end portion vicinity of the transfer conveyor 23.

Thus, the distance between the transverse sealing mechanism 17 and the chute conveyor 21, and the distance between the rotating brush mechanism 20 and the chute conveyor 21, can be easily adjusted in accordance with the size and type of the bag B in the bag-manufacturing and packaging section 5.

Second Embodiment

The bag-manufacturing and packaging system 3 pertaining to another embodiment of the invention will now be described using FIG. 19.

The bag-manufacturing and packaging system 3 of the present embodiment is different from the bag-manufacturing and packaging system described in the first embodiment in that a combination of a single rotating brush 221 and the chute conveyor (belt conveyor) 21 (see FIG. 19) is used as the drop orientation control unit instead of the pair of rotors (rotating brushes 201*a* and 201*b*).

Figure 19:
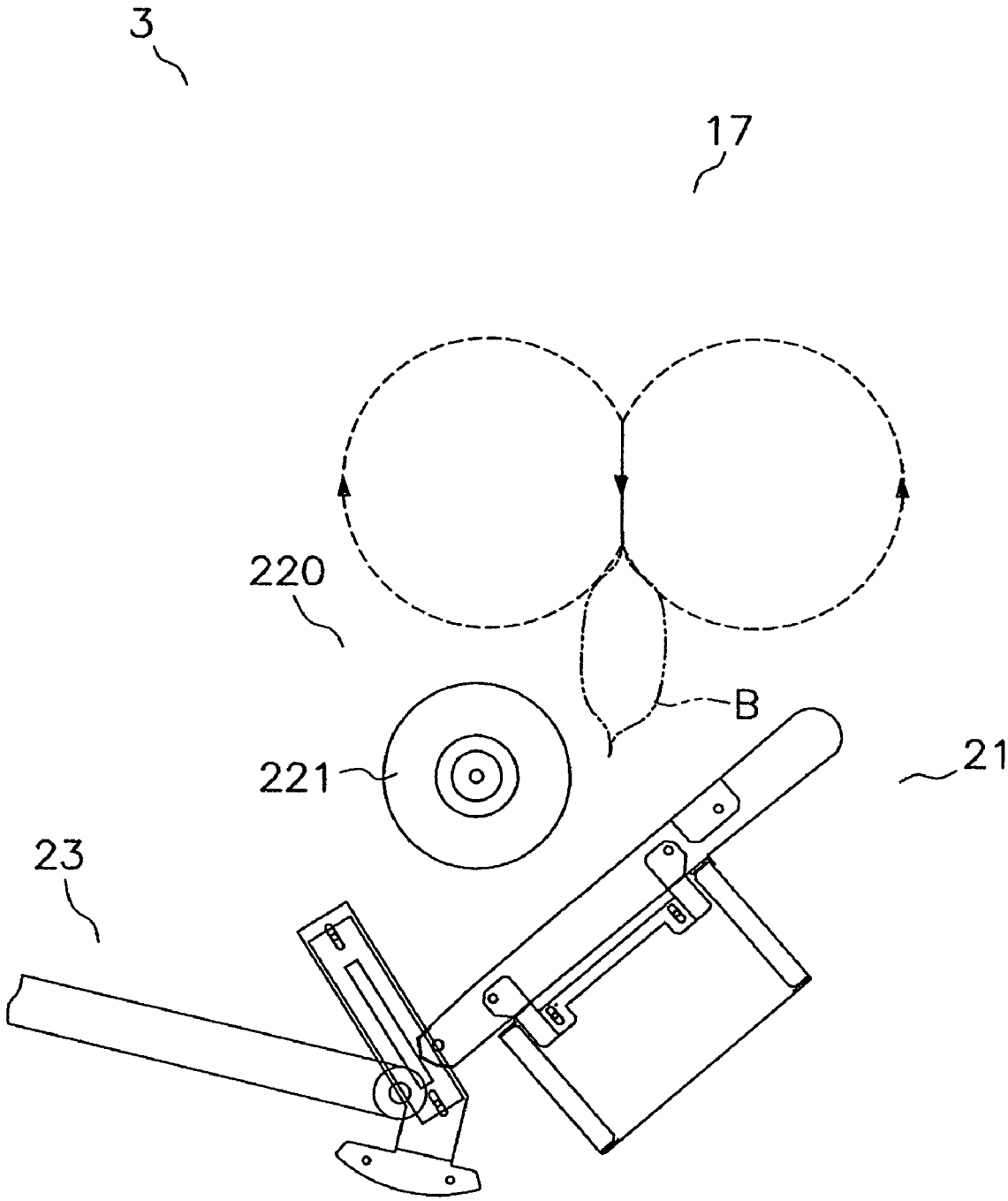

Namely, in the bag-manufacturing and packaging system 3 of the present embodiment, the rotating brush 221 is disposed directly downstream of the transverse sealing mechanism 17 in the bag-manufacturing and packaging section 5, as shown in FIG. 19, and the bag B fed from the transverse sealing mechanism 17 is conveyed by the rotating brush 221 to a predetermined position on the chute conveyor 21.

Here, the bag B discharged from the transverse sealing mechanism 17 is fed to the transfer conveyor 23 while being sandwiched between the rotating brush 221 of a rotating brush mechanism 220 and the chute conveyor 21.

At this time, the bag B discharged from the transverse sealing mechanism 17 is sandwiched between the rotating brush 221 and the chute conveyor 21 and fed to the transfer conveyor 23 in a state where the drop orientation of the bag B is stable.

Also, the bag B sandwiched between the rotating brush 221 and the chute conveyor 21 is forcibly cut from the sealing jaws 51 and 52 of the transverse seal mechanism 17 by the rotational drive forces of the rotating brush 221 and the chute conveyor 21.

Moreover, even when the bottom of the bag B sandwiched between the rotating brush 221 and the chute conveyor 21 is swollen as shown in FIG. 12(*a*), the bag B can be evened out in the thickness direction as shown in FIG. 12(*b*) when discharged.

The rotating brush 221 rotates at the same rotational speed as, or a rotational speed greater than, the drop speed of the bag B discharged from the transverse sealing mechanism 17.

<Characteristics of the Bag-Manufacturing and Packaging System 3>

(1)

The bag-manufacturing and packaging system 3 of the present embodiment is disposed with the rotating brush mechanism 220 that includes the single rotating brush 221, as shown in FIG. 19, and the bag B is sandwiched between the rotating brush 221 and the conveyance surface of the chute conveyor 21 and conveyed to the transfer conveyor 23.

By combining the single rotating brush 221 with the chute conveyor 21 in this manner, the drop orientation of the bag B discharged from the transverse sealing mechanism 17 can be controlled even with the rotating brush mechanism 220 disposed with the single rotating brush 221. Also, because a force in the conveyance direction is imparted to the bag B while the bag B is sandwiched between the rotating brush 221 and the chute conveyor 21, the bag B can be forcibly cut from the sealing jaws 51 and 52 of the transverse sealing mechanism 17. Thus, the bag B can be prevented from clinging to and moving with the sealing jaws 51 and 52 even after the completion of the transverse sealing operation. Moreover, because the bag B is sandwiched between the rotating brush 221 and the chute conveyor 21 when conveyed, the bag B can be made uniform in the thickness direction when delivered to the transfer conveyor 23.

(2)

In the bag-manufacturing and packaging system 3 of the present embodiment, the rotating brush 221 is rotated at the same speed as, or at a slightly greater speed than, the drop speed of the bag B discharged from the transverse sealing mechanism 17.

Thus, the bag B can be conveyed downstream so as to be cut from the transverse sealing mechanism 17, and the bag B can be smoothly conveyed downstream while its drop orientation is maintained.

Third Embodiment

A bag-manufacturing and packaging system 4 pertaining to yet another embodiment of the invention will now be described using FIGS. 20 to 22. The same reference numerals will be given to members that provide the same action as members already described in the preceding first and second embodiments, and description thereof will be omitted.

As shown in FIG. 20, the bag-manufacturing and packaging system 4 of the present embodiment is provided with a pullout mechanism 238 with which the rotating brush mechanism 230 is pulled out from directly below the transverse sealing mechanism 17 (see the chain double-dashed line in FIG. 20) along slide rails 233*a* and 233*b* by pivoting a lever 234 in a predetermined direction. The rotating brush mechanism 230 is therefore different from the fixed rotating brush mechanisms 20 and 220 of the preceding first and second embodiments.

Because the rotating brush mechanism 230 can be pulled out in this manner from directly below the transverse sealing mechanism 17, rotating brushes 231*a* and 231*b* can be replaced with different types of rotating brushes, a work space can be secured when cleaning the area around the rotating brushes 231*a* and 231*b*, and the workability can be significantly improved.

Figure 21:
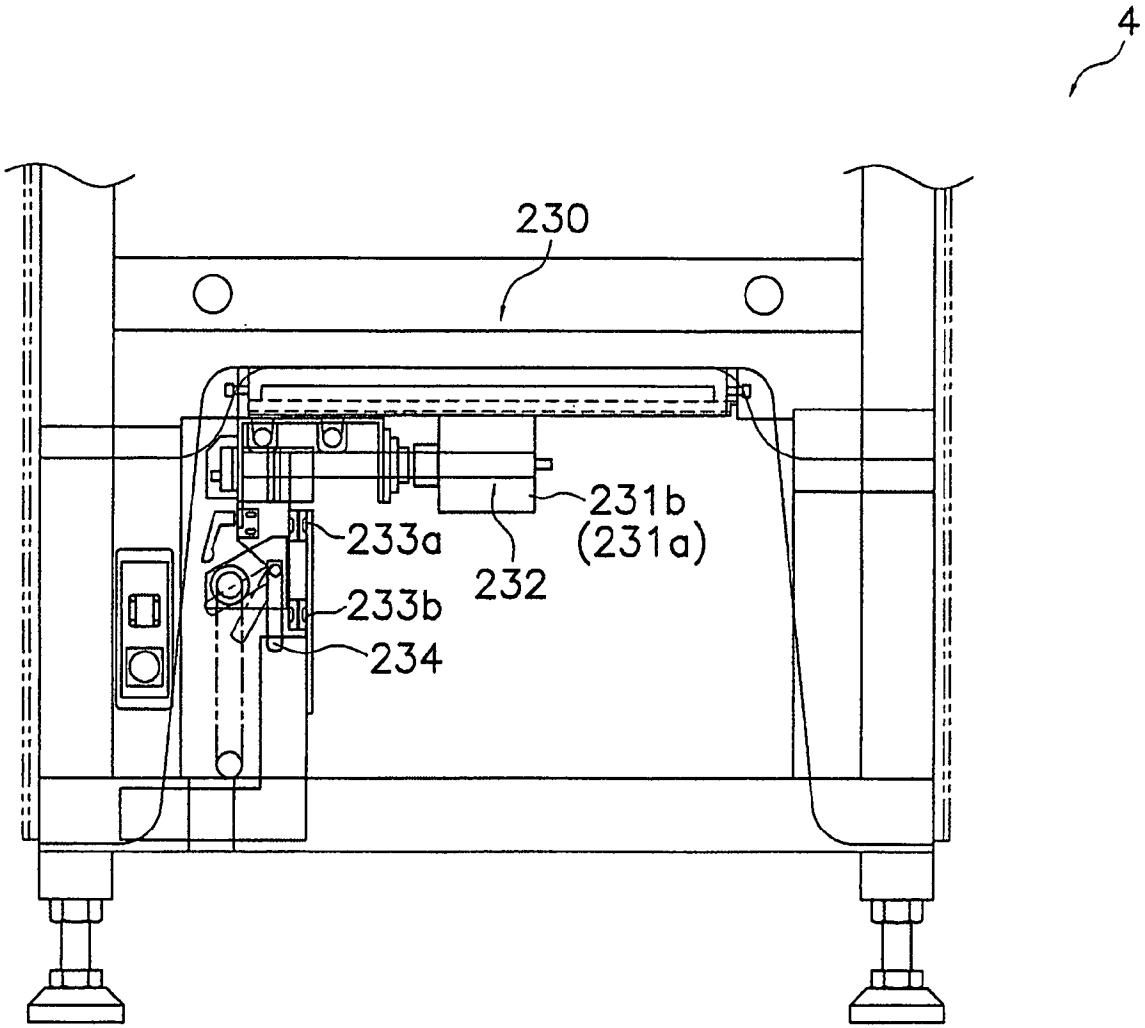

Also, in the bag-manufacturing and packaging system 4, the rotating brushes 231*a* and 231*b* are cantilever-supported by a cantilever support mechanism 232, as shown in FIG. 21. For this reason, as shown in FIG. 22, the rotating brushes 231*a* and 231*b* can be easily removed from the cantilever support mechanism 232 by simply loosening a female screw 237. When the rotating brushes 231*a* and 231*b* are to be attached, the rotating brushes 231*a* and 231*b* are pushed into the cantilever support mechanism 232, a fitting portion 235*a* fixed to the cantilever support mechanism 232 and a fitting portion 235*b* fixed to the rotating brushes 231*a* and 231*b* are fitted together, and then the rotating brushes 231*a* and 231*b* are coupled by attaching the female screw 237 to a male screw 236.

<Characteristics of the Bag-Manufacturing and Packaging System 4>

(1)

In the bag-manufacturing and packaging system 4 of the present embodiment, the rotating brush mechanism 230 can be pulled out along the slide rails 233*a* and 233*b* by the pullout mechanism 238 from directly below the transverse sealing mechanism 17, as shown in FIG. 20.

Thus, a work space for replacing or cleaning the rotating brushes 231*a* and 231*b* can be secured sufficiently, and workability, cleanability, and maintainability can be improved.

(2)

In the bag-manufacturing and packaging system 4 of the present embodiment, the rotating brushes 231*a* and 231*b* are cantilever-supported by the cantilever support mechanism 232, as shown in FIG. 21.

Figure 22:
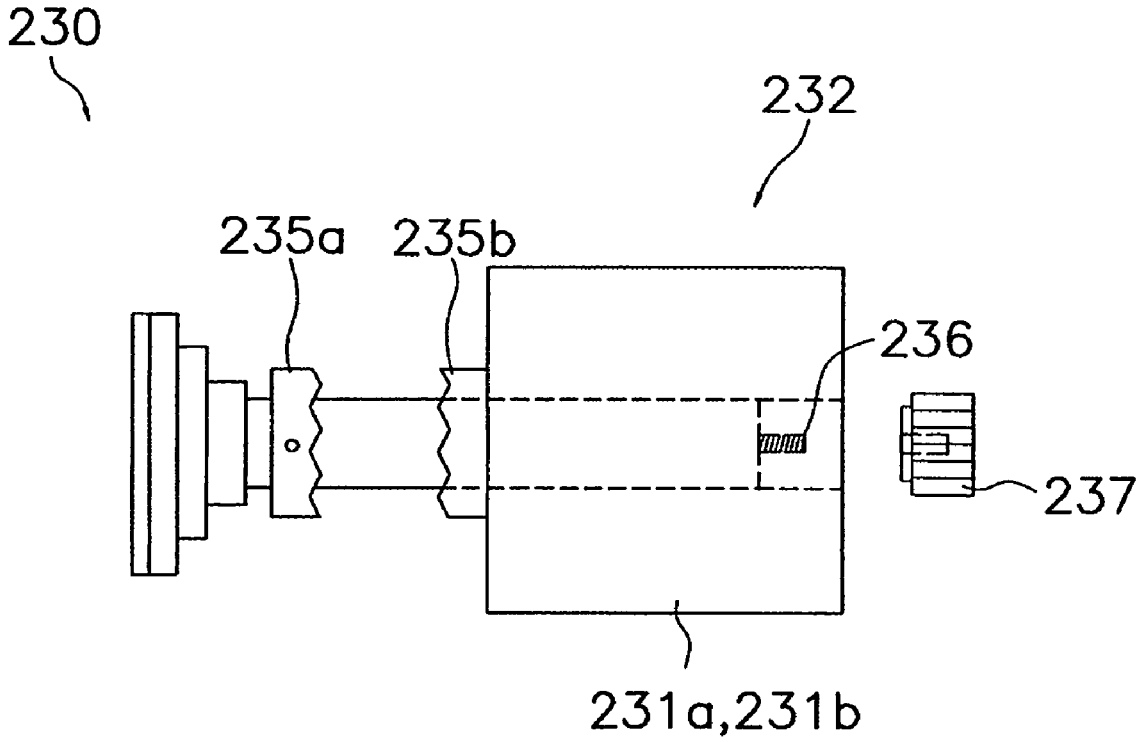

Thus, the rotating brushes 231*a* and 231*b* can be replaced more easily in comparison with the rotating brushes 201*a* and 201*b* shown in FIG. 9, which are supported from both sides (see FIG. 22).

Other Embodiments

Embodiments of the invention have been described above, but the present invention is not limited to the preceding embodiments and can be variously altered in a range that does not depart from the scope of the invention.

(A)

In the preceding embodiment, the rotating brushes 201*a* and 201*b* were described as an example of the pair of rotors. However, the present invention is not limited to this.

For example, effects that are the same as those described above can also be obtained with a configuration where sponges are adhered to the surfaces of the rotors. According to the configuration where sponges are adhered to the surfaces of the rotors, the cutting force of the bag B from the transverse sealing mechanism 17 and the effect of making uniform the bag B can be strengthened.

Rotors to whose surfaces an elastic member such as rubber or a belt has been adhered may also be used.

In other words, effects that are the same as those in the preceding embodiments can be obtained as long as the rotors include elasticity in the radial direction around their rotational axes.

(B)

In the preceding embodiments, an example was described where the sealing jaws 51 and 52 of the transverse sealing mechanism 17 moved in a substantial "D" shape. However, the present invention is not limited to this.

For example, the transverse sealing mechanism may be one disposed with rotary-type sealing jaws that are not in a substantial "D" shape, or one employing box motion or another sealing format.

(C)

In the preceding embodiments, an example was described where the two rotating brushes 201*a* and 201*b* were disposed on a horizontal plane. However, the present invention is not limited to this.

Figure 13:
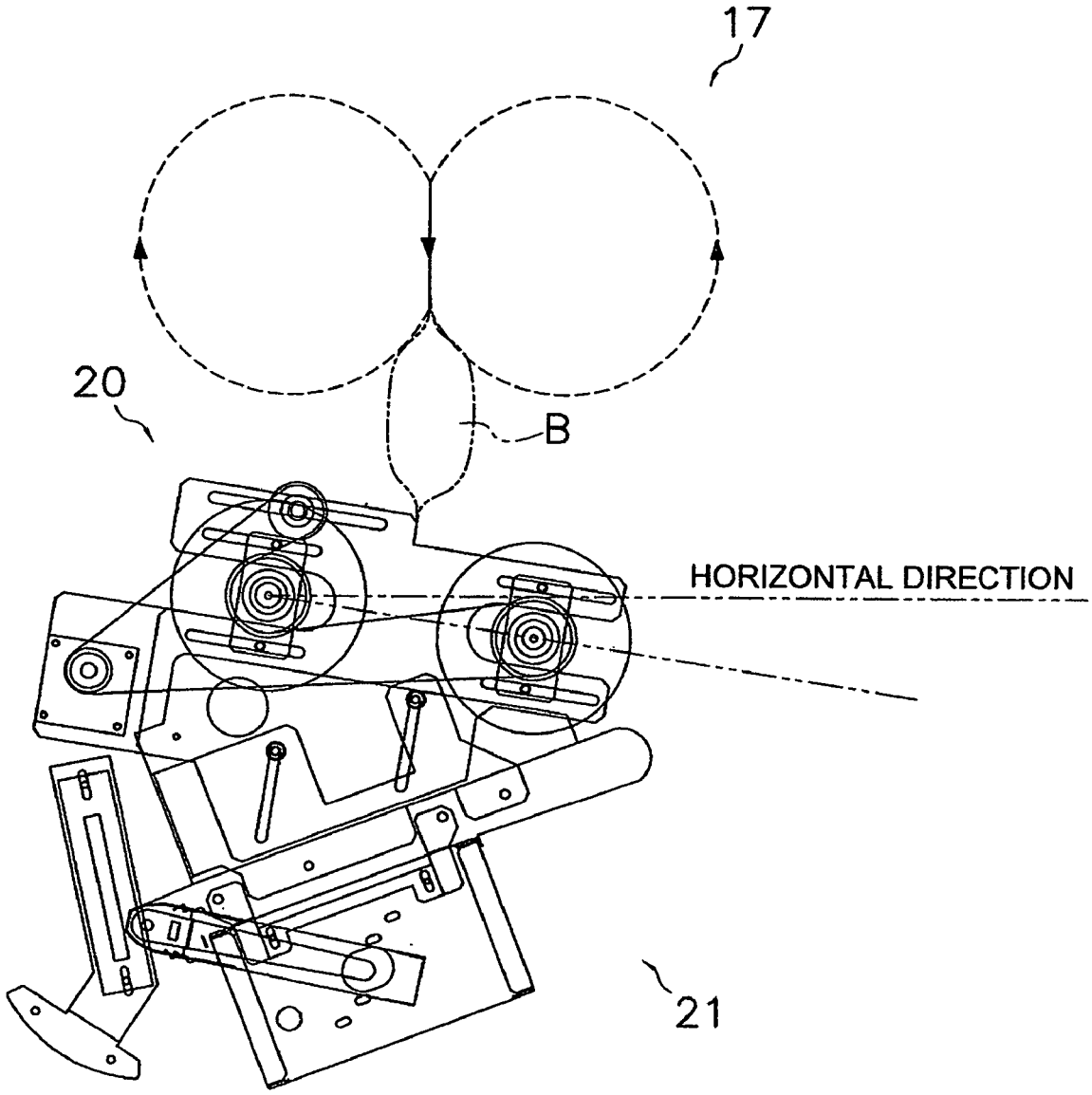

For example, as shown in FIG. 13, the two rotating brushes may also be disposed on a plane that is slanted relative to the horizontal direction. In this case, because the bag can be fed towards the conveyance direction of the bag, the bag can be dropped at an obtuse angle.

(D)

In the preceding embodiments, an example was described where the rotating brushes 201*a* and 201*b* were driven by one drive motor 202. However, the present invention is not limited to this.

Figure 14:
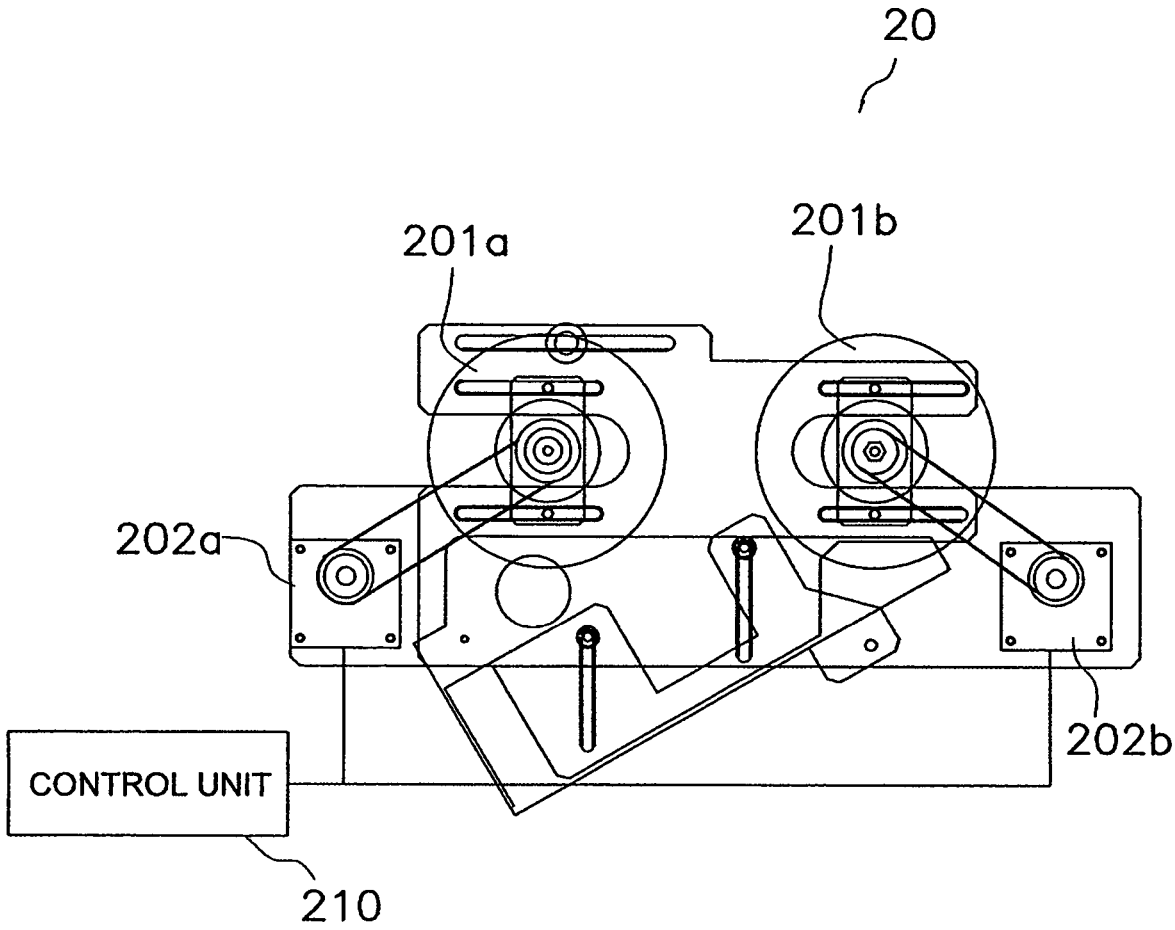

For example, as shown in FIG. 14, the invention may also be configured so that the rotating brushes 201*a* and 201*b* are independently driven by two drive motors 202*a* and 202*b*. In this case, the orientation and discharge position of the bag B discharged with respect to the chute conveyor 21 can be changed by having the rotating brushes 201*a* and 201*b* rotate at different rotational speeds.

(E)

In the preceding embodiments, an example was described where the rotating brush mechanism 20 was fixed with respect to the chute conveyor 21. However, the present invention is not limited to this.

For example, the rotating brush mechanism 20 may also be fixed with respect to the bag-manufacturing and packaging section 5 or the transfer conveyor 23. In this case, the angle of the rotating brush mechanism 20 can be maintained at a constant even if the chute conveyor 21 is pivoted and the angle of the conveyance surface is changed. Thus, it is more preferable for the rotating brush mechanism 20 to be fixed with respect to somewhere other than the chute conveyor 21.

(F)

In the preceding embodiments, an example was described where the chute conveyor 21 was disposed downstream of the rotating brush mechanism 20. However, the present invention is not limited to this.

For example, the invention may also be configured using a metal fixed chute (J chute (slide), etc.). In this case, the cost is reduced in comparison with when the chute conveyor 21 is used.

(G)

In the preceding embodiments, an example was described where the interval between the two rotating brushes 201*a* and 201*b* of the rotating brush mechanism 20 was adjusted manually. However, the present invention is not limited to this.

Figure 16:
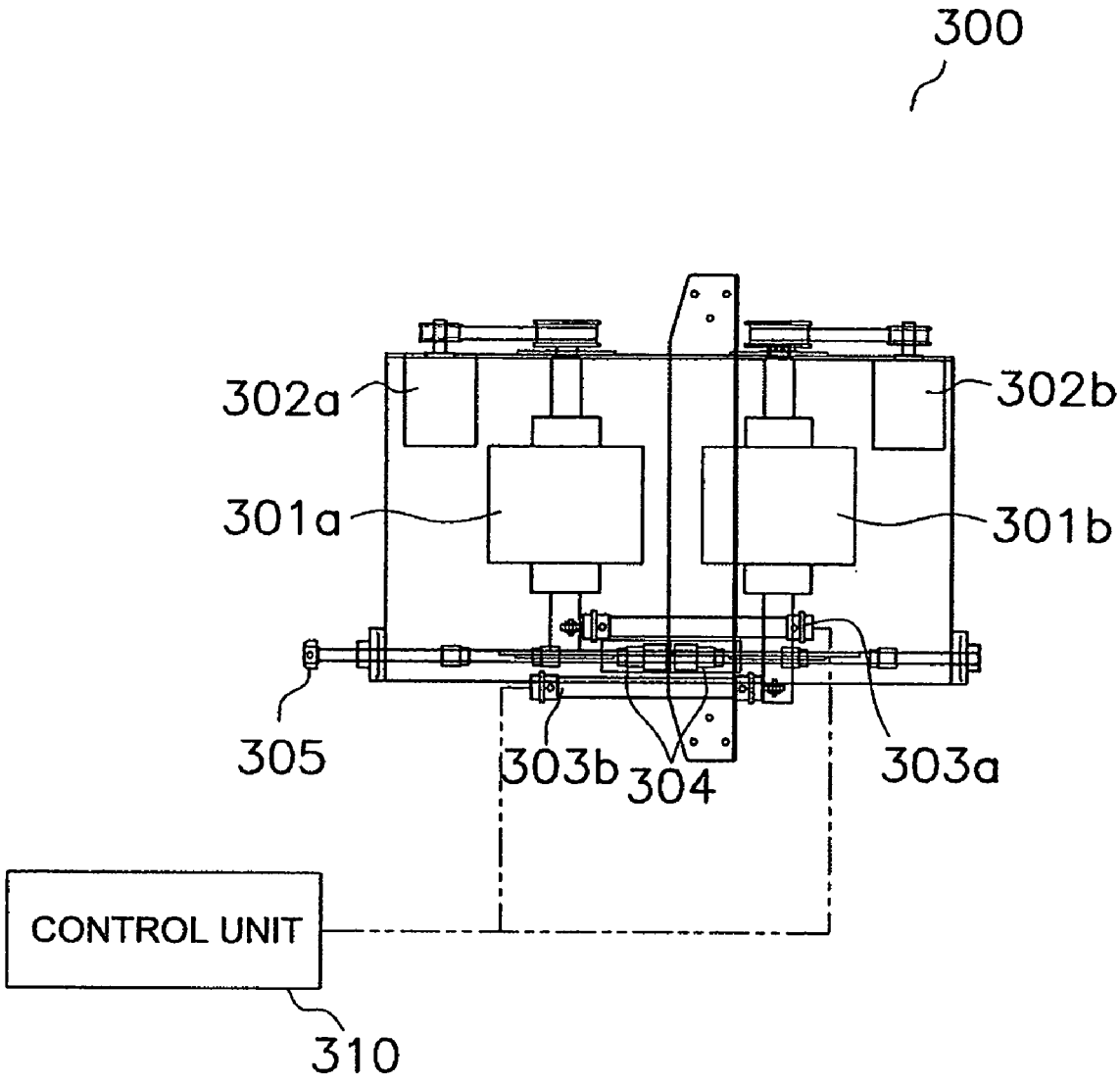

For example, as shown in FIGS. 15 and 16, the invention may also be configured to include a rotating brush mechanism 300 disposed with individual air cylinders (rotor interval adjusting units) 303*a* and 303*b* with respect to a pair of rotating brushes 301*a* and 301*b*. As shown in FIG. 16, the air cylinders 303*a* and 303*b* are connected respectively to ends of rotational shafts of the rotating brushes 301*a* and 301*b*, which are driven by drive motors 302*a* and 302*b*, and the rotational shafts are pulled out to contact regulation blocks 304. The regulation blocks 304 are disposed between the air cylinders 303*a* and 303*b* to regulate the minimum interval between the pair of rotating brushes 301*a* and 301*b*. An adjustment screw 305 is a member for adjusting the position of the regulation blocks 304. For convenience of description, an air pipe and pressure control valve (e.g., electromagnetic valve) connected to the air cylinders 303*a* and 303*b* are not shown in FIG. 16.

In the configuration of the rotating brush mechanism 300, for example, in a case where the bag-manufacturing and packaging section 5 continues running even when the chute conveyor 30 has stopped, where the bag-manufacturing and packaging section 5 needs to be adjusted to manufacture a long bag and check the status of the seal, where an abnormally light bag (including an empty bag) that has not been filled due to abnormal measurement or when a long bag has been manufactured, or where there is an instruction to discharge all bags, the control unit (interval control unit) 310 can control the unillustrated pressure control valves of the air cylinders 303*a* and 303*b* to increase the space between the rotating brushes 301*a* and 301*b*.

For example, when a long bag has been manufactured in the bag-manufacturing and packaging section 5, it is necessary to change the conveyance orientation of the bag so that the long bag which has been conveyed in a vertical direction from the bag-manufacturing and packaging section 5 moves upward from the chute conveyor 21 towards the transfer conveyor 23 above the horizontal direction. For this reason, it is difficult to smoothly convey an abnormal bag such as a long bag on the chute conveyor 21.

Thus, in the rotating brush mechanism 300 shown in FIGS. 15 and 16, when the control unit 310 detects that an abnormal bag such as a long bag has been manufactured, the control unit 310 controls the air cylinders 303*a* and 303*b* to increase the interval between the rotating brushes 301*a* and 301*b*. Thus, even when a bag that is not regular, such as a long bag, is manufactured in the bag-manufacturing and packaging section 5 due to some kind of trouble, the control unit 310 controls the air cylinders 303*a* and 303*b* to increase the distance between the rotating brushes, so that such bags can be smoothly conveyed downstream.

Electrically powered actuators may also be used in place of the air cylinders 303*a* and 303*b*. In this case, for example, the control unit 310 may drive the electrically powered actuators on the basis of the size of the bag to be manufactured, and automatically adjust the interval between the rotating brushes 301 and 301*b*.

(H)

The bag-manufacturing and packaging system may also be disposed with an automatic pressure adjustment valve (not shown) that automatically adjusts the air pressure in the air cylinders 303*a* and 303*b*, and may be provided with the function of automatically finely adjusting the air pressure of the air cylinders 303*a* and 303*b*. In this case, the degree of constriction between the rotating brushes 301*a* and 301*b* resulting from the air cylinders 303*a* and 303*b* can be adjusted in accordance with the type and size of the bag conveyed between the rotating brushes 301*a* and 301*b*, to impart elasticity.

Moreover, the rotating brushes 301*a* and 301*b* may also be fixed via elastic members such as springs. In this case, the bag may be conveyed while finely increasing the distance between the rotating brushes 301*a* and 301*b* when the bag is sandwiched, whereby the bag can be smoothly conveyed, without applying excessive pressure, while applying appropriate pressure to the bag.

(I)

Figure 18:
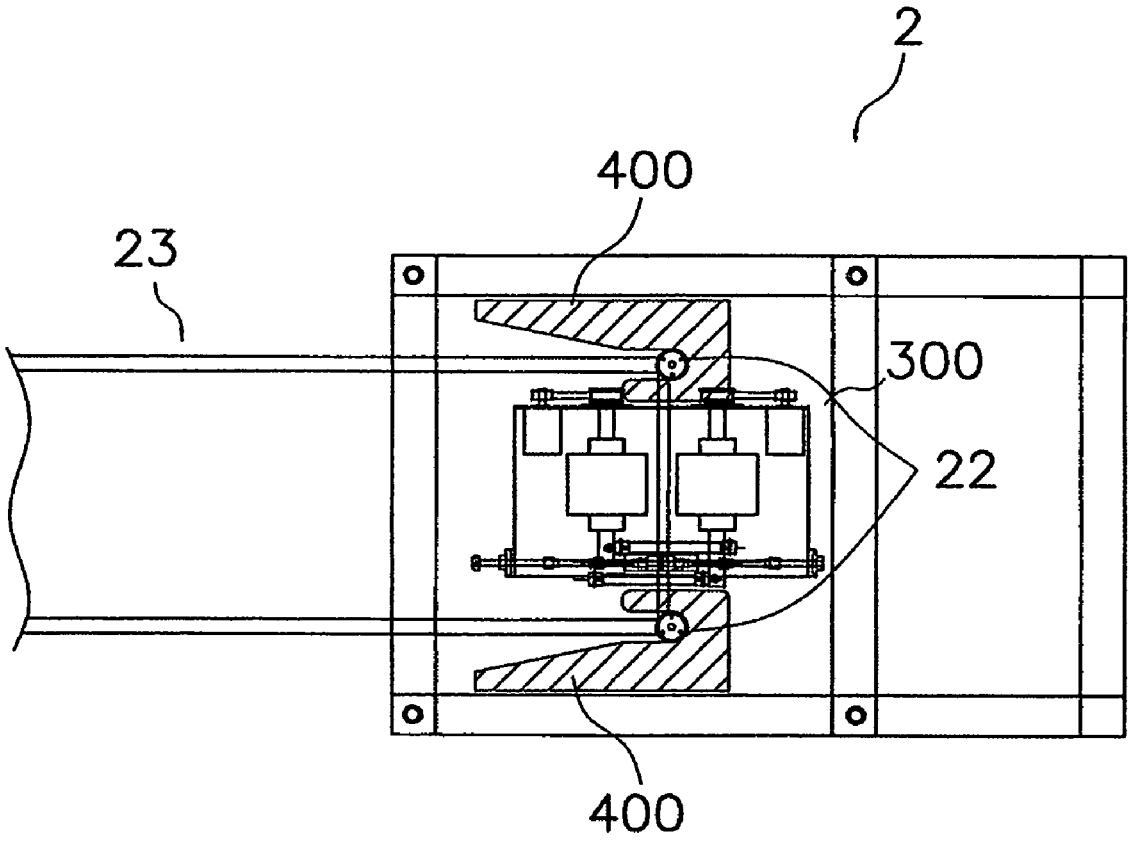

The bag-manufacturing and packaging system may also be configured to precisely position the rotating brush mechanism 300 with respect to the bag-manufacturing and packaging section 5, as shown in FIGS. 17 and 18. Here, positioning plates 400 are disposed beneath the bag-manufacturing and packaging section 5, and positioning foot portions 22, to which a unit including the rotating brush mechanism 300 and the chute conveyor 21 is connected, is fitted together with recess portions (see FIG. 18) formed in the positioning plates 400.

In this case, downstream devices including the rotating brush mechanism 300 can be precisely disposed with respect to the position at which the bag of the bag-manufacturing and packaging section 5 is discharged. Thus, the manufactured bag can be smoothly conveyed downstream.

(J)

In the preceding embodiments, an example was described where the chute conveyor 21 disposed directly below the rotating brushes 201*a* and 201*b* included a linear conveyance surface when seen from the side. However, the present invention is not limited to this.

Figure 23:
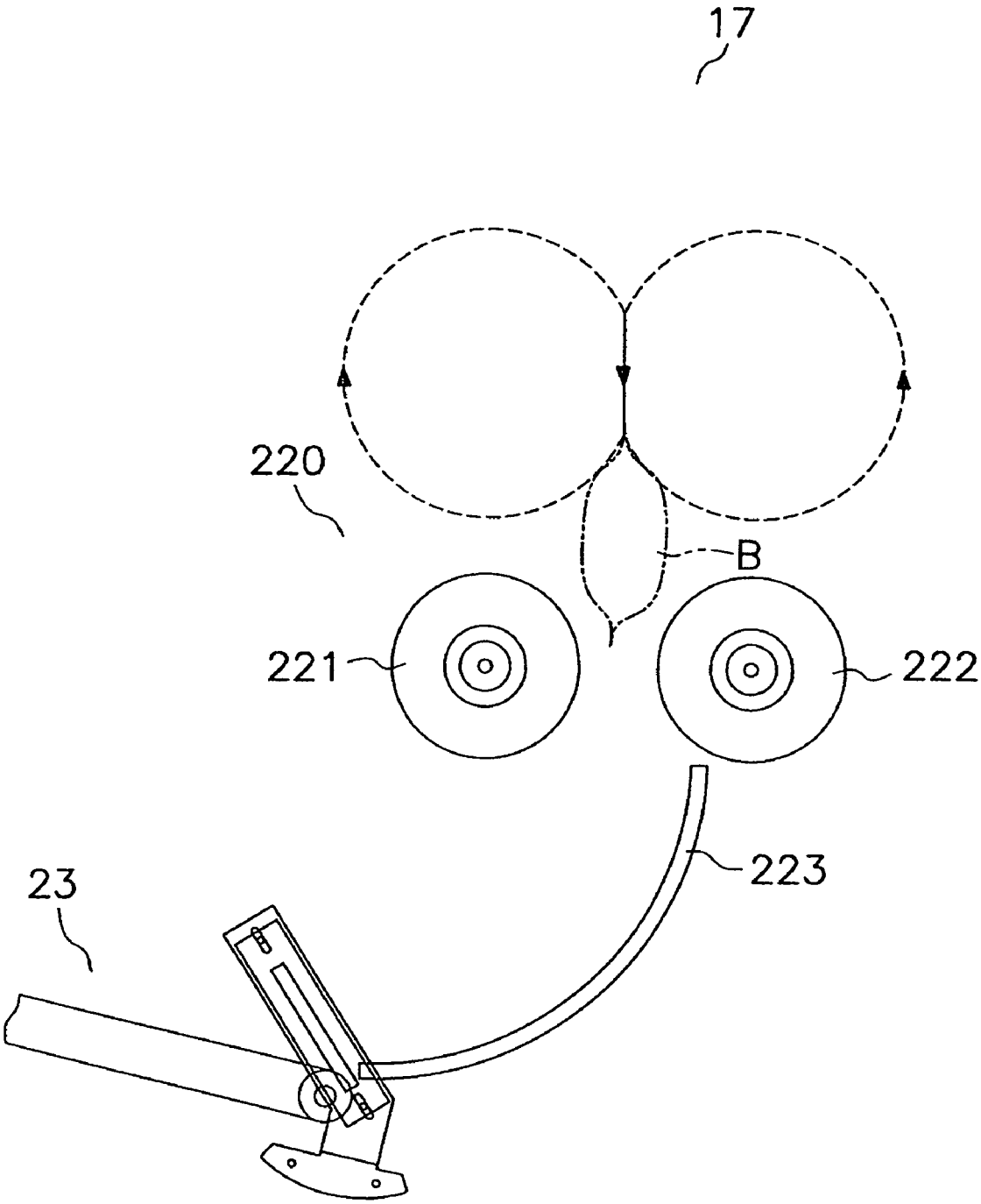
Figure 24:
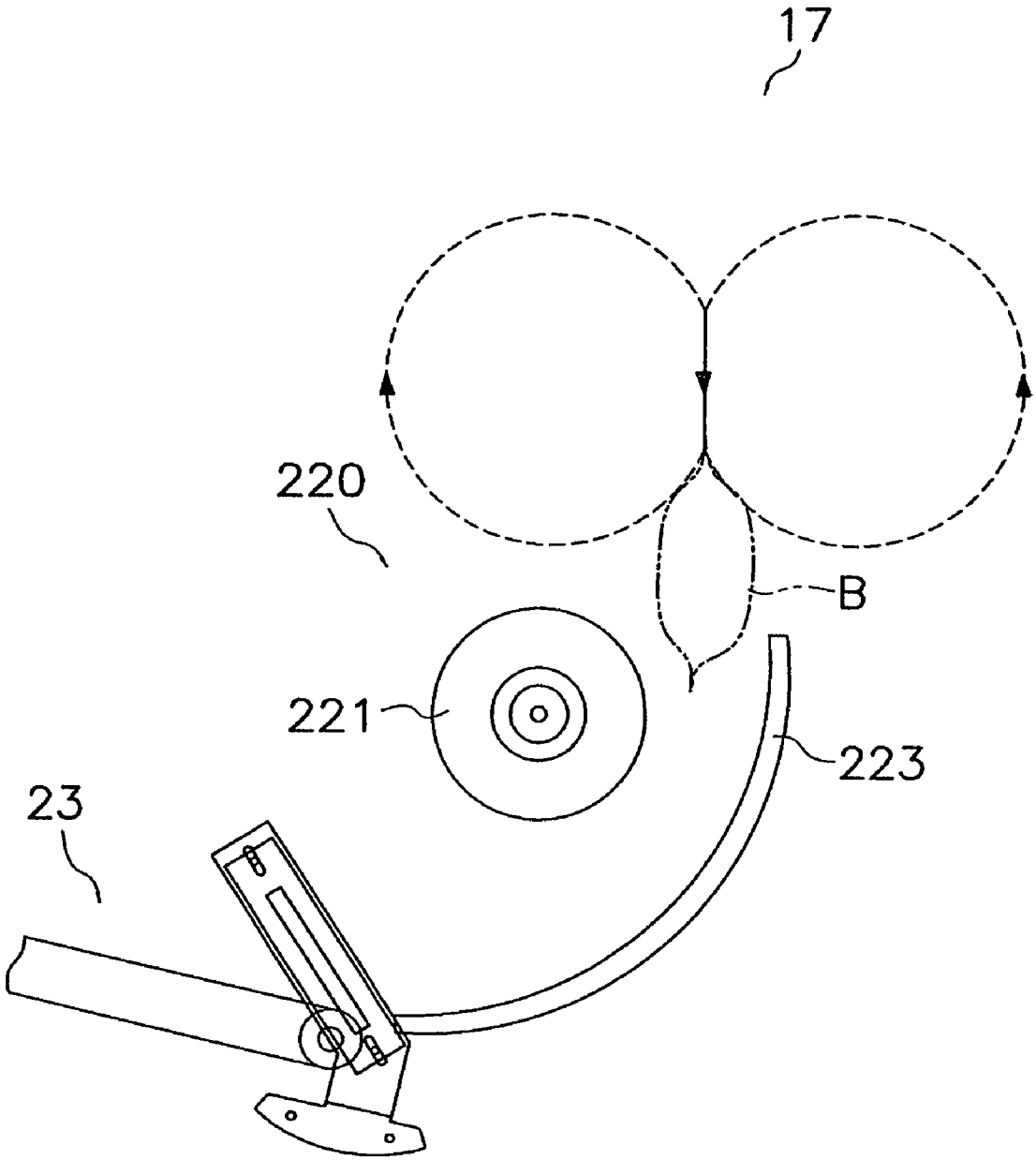

For example, as shown in FIGS. 23 and 24, a fixed chute 223 that is J-shaped when seen from the side can also be used in place of the chute conveyor 21 having the linear conveyance surface when seen from the side.

(K)

In the preceding embodiments, examples were described where one or two rotating brushes were used as the drop orientation control unit. However, the present invention is not limited to this.

Figure 25:
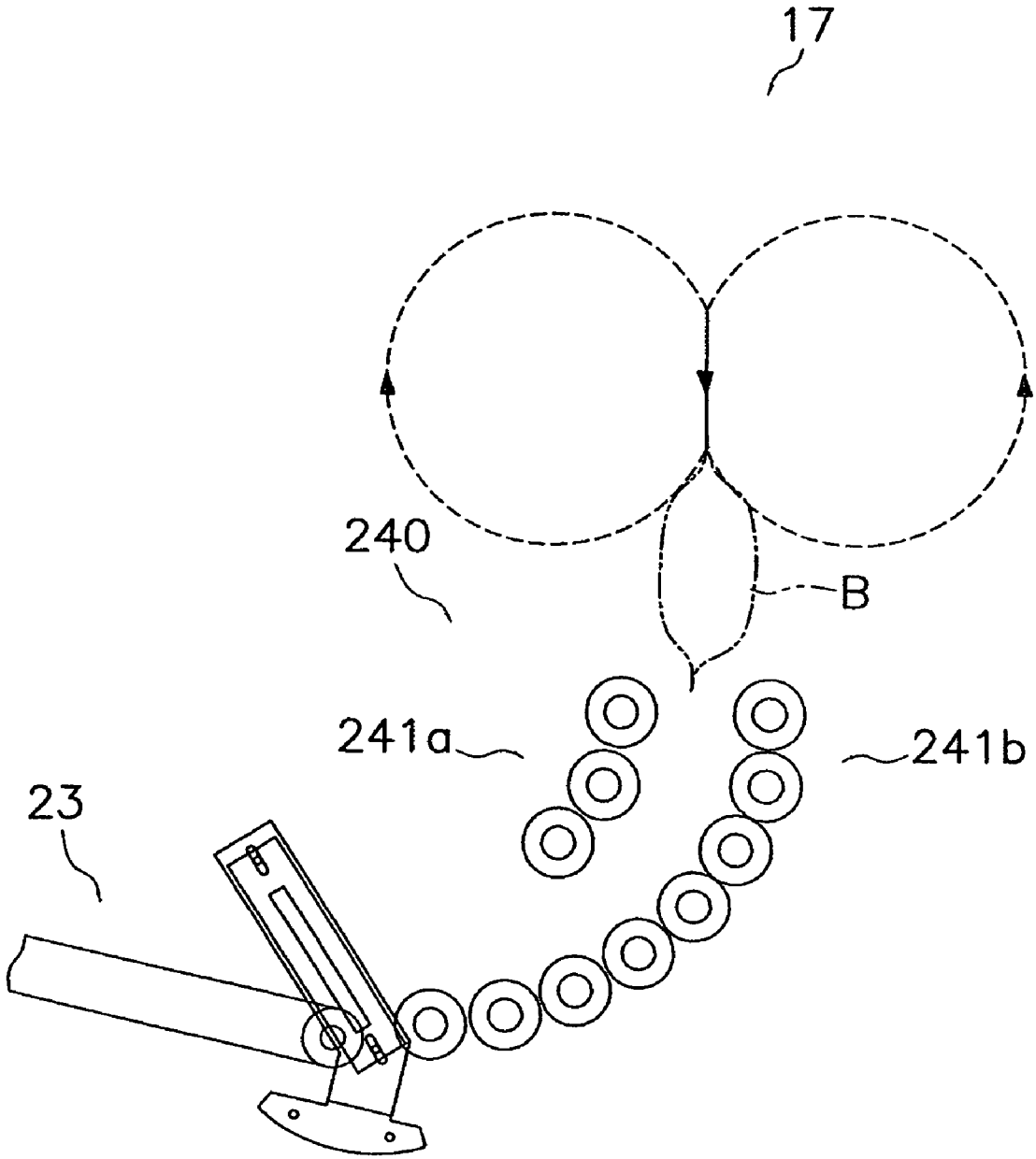

For example, as shown in FIG. 25, a multiple serial rotating brush (multiple rotor) 240 comprising a group of a plurality of rotating brushes can also be used as the drop orientation control unit.

In this case, as shown in FIG. 25, the bag B can be smoothly conveyed to the predetermined position while the drop orientation of the bag B is maintained, by conveying the bag B so that it is sandwiched between a rotating brush group 241*a* and a rotating brush group 241*b*.

(L)

In the preceding embodiments, as example was described where circular cylinder-type rotating brushes were used as the drop orientation control unit. However, the present invention is not limited to this.

Figure 26:
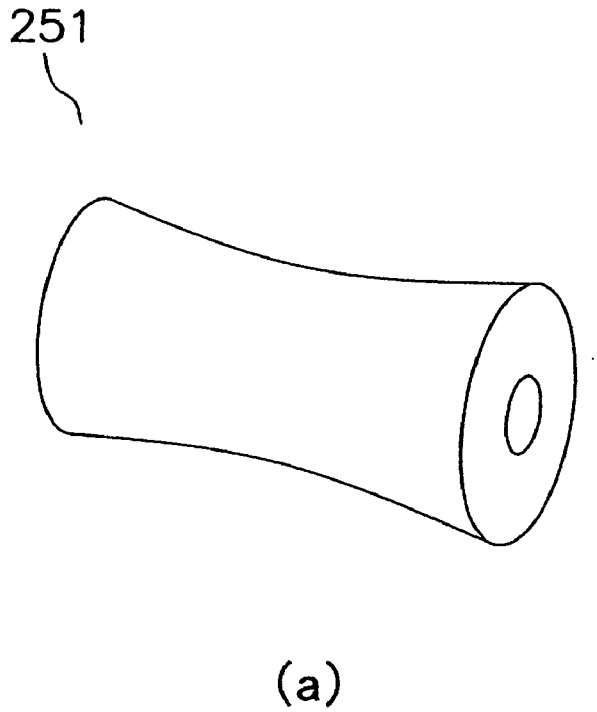
Figure 26:
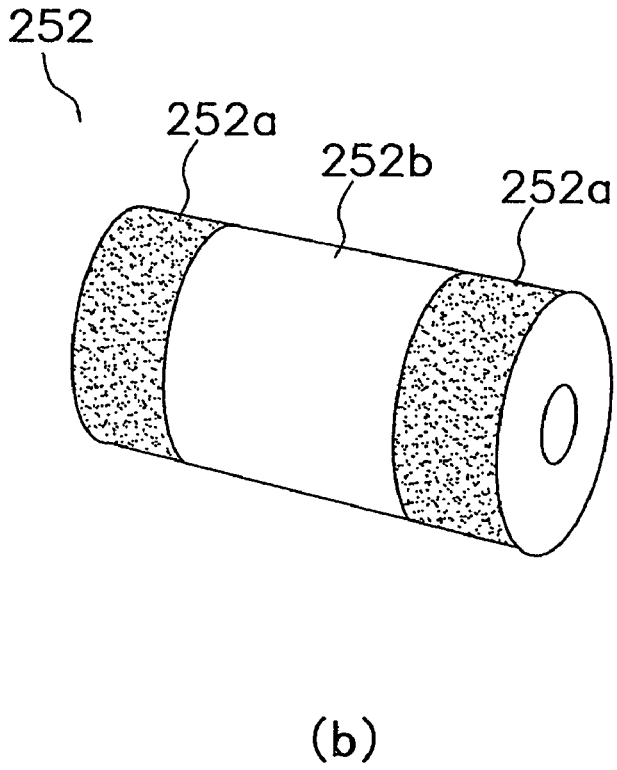

For example, as shown in FIG. 26(*a*), a rotating brush 251, to which a brush having longer bristles at both ends in the rotational axis direction (width direction of the rotating brush) than those at the center portion, may also be used.

Moreover, as shown in FIG. 26(*b*), a rotating brush 252, in which the brush at both end portions 252*a* in the rotational axis direction (width direction of the rotating brush) is harder than that at a center portion 252*b*, may also be used.

When either of the rotating brushes 251 and 252 is used, the bag B can be fed to the transfer conveyor 23 while maintaining a more stable drop orientation because the bag B is sandwiched along the shape of the bag B.

The rotating brush with such a configuration may be a pair of rotors or structured as a single rotor.

A material such as a sponge, rubber, or a belt with different thicknesses and hardnesses can also be used in lieu of a brush as the rotor having different lengthes or hardnesses in the both end portions and the center portion in the rotational axis direction.

(M)

In the preceding embodiments, an example was described where the rotating brush was used only as a drop orientation control unit. However, the present invention is not limited to this.

Figure 27:
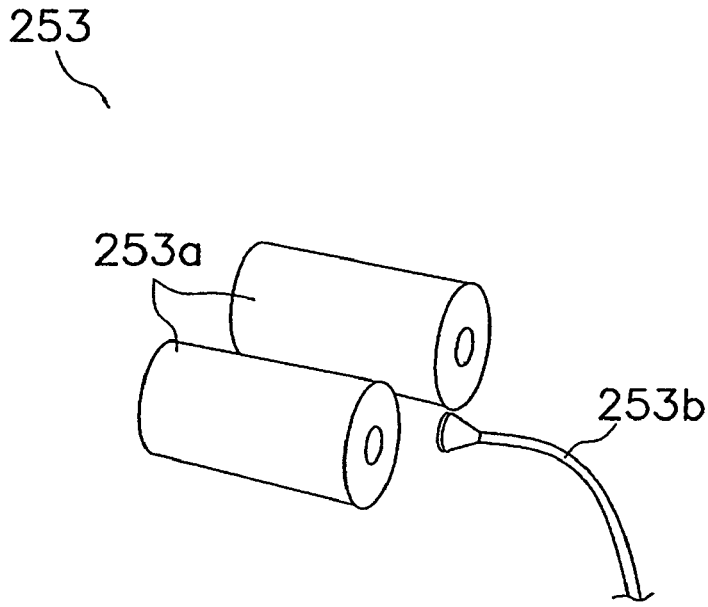
Figure 27:
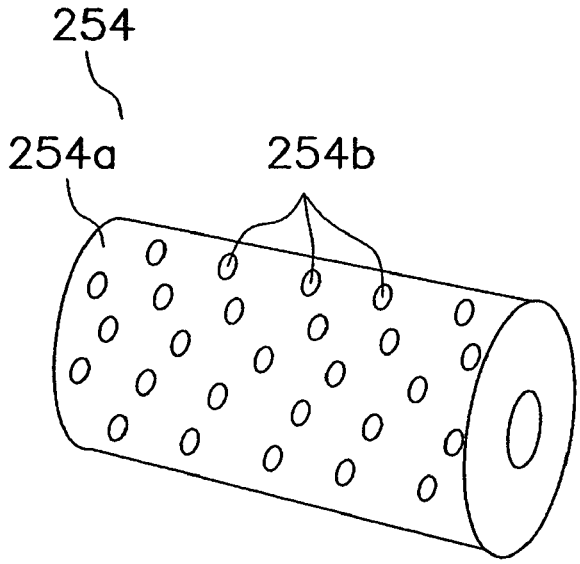

For example, as shown in FIG. 27(*a*), in addition to its function as a drop orientation control unit, the rotating brush mechanism may also comprise a rotating brush mechanism 253 that cools the seal portion sealed by the transverse sealing mechanism 17 with an air nozzle (cooling mechanism) 253*b* disposed in the vicinity of a pair of rotating brushes 253*a*.

Moreover, as shown in FIG. 27(*b*), the rotating brush mechanism may comprise a rotating brush mechanism 254 where air blowout holes (cooling mechanism) 254*b* are formed in the axial core portion of a rotating brush 254*a*.

As shown in FIGS. 27(*a*) and 27(*b*), by adding to the rotating brush mechanism a function as a cooling mechanism that cools the seal portion of the bag, the tearing of the seal portion, which occurs because the heat of the seal portion has not been sufficiently cooled while the bag is conveyed, can be prevented while the bag is conveyed being sandwiched by the rotating brush mechanism.

INDUSTRIAL APPLICABILITY

The bag-manufacturing and packaging system of the present invention is widely applicable to devices that convey the bag-like object downstream, because it provides the effects of preventing inconsistencies in the pitch of the bag in the conveyance unit following the bag-manufacturing and packaging machine, and enables the contents of the bag to be evened out.

The invention claimed is:

1. A bag-manufacturing and packaging system comprising:

a vertical bag-manufacturing and packaging machine that is configured to manufacture a bag by seating a tubular continuous packaging material filled with items to be packaged, and to cut and discharge the bag at a predetermined discharge position;

a conveyance unit that is configured to receive the bag discharged from the vertical bag-manufacturing and packaging machine and convey the bag downstream; and a drop orientation control unit that is disposed between the vertical bag-manufacturing and packaging machine and the conveyance unit and configured to feed the bag discharged from the vertical bag-manufacturing and packaging machine substantially to a predetermined position on the conveyance unit while maintaining the drop orientation of the bag even when the bag is discharged from the vertical bag-manufacturing and packaging machine at a position other than the predetermined discharge position.

2. The bag-manufacturing and packaging system of claim 1, wherein the drop orientation control unit includes a rotor that feeds the bag discharged from the vertical bag-manufacturing and packaging machine substantially to the predetermined position on the conveyance unit.

3. The bag-manufacturing and packaging system of claim 2, wherein the drop orientation control unit includes another rotor such that the pair of rotors sandwich the bag discharged from the vertical bag-manufacturing and packaging machine and feed the bag to the predetermined position on the conveyance unit.

4. The bag-manufacturing and packaging system of claim 3, wherein the pair of rotors have elasticity in a radial direction around their rotational axes.

5. The bag-manufacturing and packaging system of claim 3, wherein an interval between the pair of rotors is adjustable.

6. The bag-manufacturing and packaging system of claim 3, wherein the pair of rotors are independently driven.

7. The bag-manufacturing and packaging system of claim 3, further comprising a rotation control unit that is configured to control rotational speeds of the pair of rotors.

8. The bag-manufacturing and packaging system of claim 3, wherein the pair of rotors are disposed such that rotational axes of the rotors are on a horizontal plane.

9. The bag-manufacturing and packaging system of claim 3, wherein the pair of rotors are disposed such that the rotational axes of the rotors are on a plane that is slanted relative to a horizontal direction.

10. The bag-manufacturing and packaging system of claim 3, wherein the vertical bag-manufacturing and packaging machine includes a longitudinal sealing mechanism that seals a sheet-like packaging material along a conveyance direction when forming the packaging material into a tubular form, and a transverse sealing mechanism that seals the tubular packaging material in a direction perpendicular to the conveyance direction of the packaging material, and the pair of rotors are disposed at a position that is directly below the predetermined discharge position of the bag in the transverse sealing mechanism and lower by about a conveyance direction length of one bag.

11. The bag-manufacturing and packaging system of claim 10, wherein the transverse sealing mechanism includes a pair of rotary-type sealing jaws.

12. The bag-manufacturing and packaging system of claim 3, wherein the conveyance unit is disposed at a position that is directly below the pair of rotors and lower by about a conveyance direction length of one bag.

13. The bag-manufacturing and packaging system of claim 3, wherein the pair of rotors are disposed at an intermediate position between the predetermined discharge position of the bag in the vertical bag-manufacturing and packaging machine and the predetermined position on the conveyance unit at which the bag is dropped.

14. The bag-manufacturing and packaging system of claim 3, wherein the conveyance unit comprises a belt conveyor that is pivotable round a conveyance direction end of the belt conveyor.

15. The bag-manufacturing and packaging system of claim 3, further comprising a rotor interval adjustment unit that is configured to adjust the interval between the pair of rotors, and an interval control unit that is configured to control the adjustment of the interval between the pair of rotors by the rotor interval adjustment unit.

16. The bag-manufacturing and packaging system of claim 15, wherein the interval control unit configured to control the rotor interval adjustment unit in accordance with the size of the bag to be manufactured in the vertical bag-manufacturing and packaging machine.

17. The bag-manufacturing and packaging system of claim 3, further comprising a positioning member that supports the pair of rotors so as to allow the pair of rotors to adjust their positions with respect to the vertical bag-manufacturing and packaging machine.

18. The bag-manufacturing and packaging system of claim 2, wherein the rotor has an elastic member on its surface.

19. The bag-manufacturing and packaging system of claim 2, wherein the rotor rotates at the same speed as a drop speed at which the bag is discharged from the vertical bag-manufacturing and packaging machine or at a faster speed than the drop speed.

20. The bag-manufacturing and packaging system of claim 2, further comprising a cantilever support mechanism that cantilever-supports the rotor.

21. The bag-manufacturing and packaging system of claim 2, further comprising a pullout mechanism that slidably supports the rotor so as to allow the rotor to be pulled from between the vertical bag-manufacturing and packaging machine and the conveyance unit.

22. The bag-manufacturing and packaging system of claim 2, wherein side portions of the rotor in the rotational axis direction of the rotor are formed by a harder material than material with which the center portion of the rotor is formed.

23. The bag-manufacturing and packaging system of claim 2, wherein the surface of the rotor is covered by a brush that radially spreads around the rotational axis of the rotor, and bristles of the brush are longer at both side portions in the rotational axis direction of the rotor than those at the center portion.

24. The bag-manufacturing and packaging system of claim 2, wherein the rotor includes a cooling mechanism configured to cool a seal portion of the bag discharged from the vertical bag-manufacturing and packaging machine.

25. The bag-manufacturing and packaging system of claim 2, wherein the conveyance unit has a fixed chute, and the drop orientation control unit is configured to sandwich the bag discharged from the vertical bag-manufacturing and packaging machine between the rotor and a conveyance surface of the fixed chute.

26. The bag-manufacturing and packaging system of claim 2, wherein the conveyance unit has a belt conveyor, and the drop orientation control unit is configured to sandwich the bag between the rotor and a conveyance surface of the belt conveyor.

27. The bag-manufacturing and packaging system of claim 1, wherein the drop orientation control unit includes a multiple serial rotor including plural rotors.

* * * * *